US005678138A

United States Patent [19]

Kobayashi et al.

[11] Patent Number: 5,678,138

[45] Date of Patent: Oct. 14, 1997

[54] PAPER TRANSPORT CONTROL SYSTEM FOR AN IMAGE FORMING APPARATUS

[75] Inventors: Mikio Kobayashi; Shuji Iseki; Junichirou Sameshima; Satoshi Fukada; Takizo Sagawa; Ryoichi Tsuruoka; Yukio Hayashi; Norio Hokari, all of Ebina, Japan

[73] Assignee: Fuji Xerox Co., Ltd., Tokyo, Japan

[21] Appl. No.: 620,084

[22] Filed: Mar. 21, 1996

[30] Foreign Application Priority Data

Mar. 24, 1995 [JP] Japan ..... 7-066544
Jun. 30, 1995 [JP] Japan ..... 7-166695

[51] Int. Cl.[6] ..... G03G 15/00

[52] U.S. Cl. ..... 399/18; 271/258.02; 271/250; 399/19; 399/22; 399/388; 399/397

[58] Field of Search ..... 399/18, 20, 19, 399/21, 22, 398, 388, 390, 397, 400, 401, 405; 271/225, 176, 184, 258.02, 259, 902

[56] References Cited

U.S. PATENT DOCUMENTS

| | | | |
|---|---|---|---|
| 4,231,567 | 11/1980 | Ziehm | 271/259 |
| 4,443,101 | 4/1984 | Sakurai et al. | 399/22 |
| 4,786,041 | 11/1988 | Acquaviva et al. | 271/259 X |
| 5,268,728 | 12/1993 | Sugiyama et al. | 399/20 |
| 5,328,168 | 7/1994 | Fox | 399/21 X |
| 5,479,240 | 12/1995 | Lee et al. | 399/21 |
| 5,502,545 | 3/1996 | Tsuruoka | 399/21 |
| 5,532,793 | 7/1996 | Kogure | 399/19 |

FOREIGN PATENT DOCUMENTS

| | | |
|---|---|---|
| 62-78577 | 4/1987 | Japan . |
| A-63-257773 | 10/1988 | Japan . |
| 1-65572 | 3/1989 | Japan . |
| A-1-109383 | 4/1989 | Japan . |
| A-4-278976 | 10/1992 | Japan . |
| A-5-94095 | 4/1993 | Japan . |
| A-5-281861 | 10/1993 | Japan . |
| 6-3889 | 1/1994 | Japan . |
| 7-281534 | 10/1995 | Japan . |
| 8-006427 | 1/1996 | Japan . |

*Primary Examiner*—Matthew S. Smith
*Attorney, Agent, or Firm*—Oliff & Berridge

[57] ABSTRACT

An image forming apparatus including a plural number of paper transporting units including at least first and second paper transporting units, in-unit paper sensing mechanism located in the first paper transporting unit, unit-to-unit paper sensing mechanism located between the first and second paper transporting units, and drive control mechanism for controlling the operations of the plural number of the paper transporting units, wherein the drive control mechanism includes first mechanism operating such that when any of the in-unit paper sensing mechanism located in the first paper transporting unit detects a paper transport trouble, the first mechanism stops the paper transporting operation of the second paper transporting unit in response to a sensing signal indicative of the presence of a paper from the unit-to-unit paper sensing mechanism, and second mechanism stops the paper transporting operation of the first paper transporting unit upon the stop of the paper transporting operation of the second paper transporting unit, and drives the first paper transporting unit to move the paper a predetermined distance in the direction that is reverse to the normal direction.

9 Claims, 14 Drawing Sheets

THE SIZE OF THE IMAGE RECORDING MEDIUM 432mm
THE NUMBER OF THE IMAGE FORMING AREAS IS 4

THE SIZE OF THE IMAGE RECORDING MEDIUM 432mm
THE NUMBER OF THE IMAGE FORMING AREAS IS 3

THE SIZE OF THE IMAGE RECORDING MEDIUM 216mm
THE NUMBER OF THE IMAGE FORMING AREAS IS 8

THE SIZE OF THE IMAGE RECORDING MEDIUM 216mm
THE NUMBER OF THE IMAGE FORMING AREAS IS 6

| TABLE 1 | 3 PITCH | 4 PITCH | 6 PITCH | 8 PITCH |
|---|---|---|---|---|
| 1 POP | NO | NO | NO | YES |
| 2 POP | NO | NO | NO | NO |
| 3 POP | YES | NO | YES | NO |
| 4 POP | NO | NO | NO | NO |

PAPER TRANSPORT CONTROL SYSTEM FOR AN IMAGE FORMING APPARATUS

BACKGROUND OF THE INVENTION

The present invention relates to an image forming apparatus having a plural number of paper transporting units, and more particularly to an image forming apparatus in which when a jam trouble happens in the paper transporting units, a jammed paper can easily be removed.

An image forming apparatus of the type in which papers are electrostatically attracted onto a belt- or drum-like image recording medium holding member and image information is electrostatically transferred from a photoreceptor to the paper held thereon, is widely used for the output device of the Xerography-basis copying machine, laser printer, LED printer, facsimile machine, the word processor, or the like.

In this type of the image forming apparatus, when a state of the leading edge of the paper causes a gap between the image recording medium holding member and the paper, a called POP (paper on photoreceptor) jam or clinging jam occasionally happens. That is, in transferring a toner image from the photoreceptor onto the paper, a peeling-off discharging phenomenon occurs. In the phenomenon, the paper will separate from the image recording medium holding member and move toward the photoreceptor, and electrostatically be attracted to the photoreceptor.

This necessitates a measure to prevent the POP jam occurrence, a measure to less damage the apparatus when the POP jam occurs, and a measure to easily remove the jammed paper.

One of the known techniques for preventing the POP jam is a gripper method in which the leading edge of the paper is mechanically held onto the image recording medium holding member. In another POP jam preventing technique, the factors of the portion of the photoreceptor or the image transferring means, which corresponds to the leading edge of the paper, are controlled so as to suppress the occurrence of the peeling-off discharging phenomenon, as disclosed in Published Unexamined Japanese Patent Application No. Sho. 63-257773, and Published Unexamined Japanese Patent Application Nos. Hei. 4-278976 and 5-94095. In those techniques, a reduction area of the effective image area is increased in the paper leading part. The resultant image has an increased non-image part on the leading part of the printed paper.

Another POP jam preventing technique is disclosed in Published Unexamined Japanese Patent Application No. Hei. 4-294760. In the technique, a guide is disposed upstream of a place where the photoreceptor comes in contact with the image recording medium holding member, to thereby prevent the paper from being separated from the image recording medium holding member. Published Unexamined Japanese Patent Application No. Hei. 5-281861 disclose an additional POP jam preventing technique. In the technique, a paper holding member is provided upstream of the image transferring stage, to thereby prevent the paper from bending toward the photoreceptor.

There are frequent occasions where the paper is placed in a high humidity condition, its leading edge is bent by humidity, and an image is formed and fixed on one side of the paper, and the paper bearing the image thereon is jammed. Any of those conventional techniques cannot cope with such a jam trouble, however. So far as we know, such a technique as to effectively suppress the occurrence of the POP jam while keeping the effective image area is not known.

A measure to minimize the damage of the apparatus when the POP jam occurs is taken. In the measure, to quickly detect a jam trouble and to stop the apparatus, on the layout of the sensors and the sensing sequence, for example, as disclosed in Published Unexamined Japanese Patent Application No. Hei. 1-109383, a part of the apparatus is reversely turned after the jam occurs, to thereby allow the jammed paper to easily be removed.

The applicant of the present Patent Application proposed an image forming apparatus for forming a multi-color image in which a image recording medium, such as a paper, is electrostatically attracted onto a belt-like image recording medium holding member, and a-toner image as image information is transferred onto the image recording medium in a superposed manner while the image recording medium is transported along a plural number of image transferring means for transferring the image information from the photoreceptor onto the image recording medium. In the image forming apparatus, when the image recording medium, such as a paper, is improperly peeled off the image recording medium holding member after the image transferring process is completed, the image recording medium holding member is reversely turned, to thereby allow the jammed paper to easily be removed from the apparatus.

In the image forming apparatus having a plural number of image transferring means, a plural number of papers are frequently present in the apparatus when the POP jam occurs. In this case, those papers will be present in a plural number of units (a paper transporting unit forming an image transferring means including the photoreceptor, a paper transporting unit forming a fixing unit, a paper supply or circulating unit, and the like).

When a jam occurs and the operation of the image forming apparatus is stopped, the apparatus visually presents a location of the jam and waits till the jammed paper is manually removed by a user. After the removal of the jammed paper is completed, the apparatus discharges outside all of the papers left in the apparatus, and is ready for the restart of the copying operation.

The work of removing-the jammed paper is put into the hands of the user in principle. Those users skilled in the handling of the apparatus can smoothly remove the jammed paper and restart the operation of the apparatus. However, those users who are unskillful are likely to leave the apparatus suffering from the jam trouble as it is, not removing the jammed paper.

When the apparatus is left without removing the jam, the contact of the belt-like image recording medium holding member and the photoreceptor is continued for a long time. An image formed by restarting the copying operation of the apparatus contains a stripe pattern extending orthogonal to the paper transporting direction.

The reason for this follows. When a jam happens on the belt-like image recording medium holding member or in the paper discharging unit, the image recording medium holding member is stopped while having the paper attracted thereonto, viz., being charged. Accordingly, the charge moves from the image recording medium holding member to the photoreceptor drum, so that an abnormal potential history is formed in the drum. Parting oil of the fixing unit moves and adheres to the surface of the belt-like image recording medium holding member through the paper of the both-side copy. The parting oil is transferred from the image recording medium holding member to the photoreceptor drum. This also contributes to the stripe pattern formation.

In Published Unexamined Japanese Patent Application No. Hei. 6-3889 which discloses a tandem type color copying machine, a procedure to stop the machine after a jam occurs is referred to. In the copying machine, when the jam occurs, the belt-like image recording medium holding member is detached from the photoreceptor, the image recording medium holding member is turned at least one turn, and then the operation of the machine is stopped. Most of the jams occurring on the belt-like image recording medium holding member are categorized into the jam of the type in which the paper clings to the photoreceptor, viz., the POP jam. If the image recording medium holding member is turned in a state that the paper thus jammed is not removed, the related photoreceptor will be seriously damaged.

SUMMARY OF THE INVENTION

Accordingly, the present invention has a first object to provide an image forming apparatus in which when a POP jam occurs on the paper transporting path meandering through a plural number of paper transporting units including image transferring means, the jammed paper and the papers being transported before and the after the jammed paper may easily be removed without damaging the apparatus.

The present invention has a second object to provide an image forming apparatus in which when the apparatus suffering from a jam is left without removing the jam for a long time, no stripe pattern appears on the resultant image, thus securing a high image quality.

To achieve the first object, there is provided an image forming apparatus comprising: a plural number of paper transporting units having respectively paper transport/drive systems, each unit having a function to transport the paper as one of its functions; paper sensing means for sensing a state of the paper transport, the paper sensing means being disposed in the paper transporting units or between the adjacent paper transporting units; and control means for controlling the operation of the paper transporting units in accordance with the information derived from the paper sensing means.

The first invention as set forth in aspect 1 defines an image forming apparatus comprising: a plural number of paper transporting units including at least first and second paper transporting units; in-unit paper sensing means located in the first paper transporting unit; unit-to-unit paper sensing means located between the first and second paper transporting units; and drive control means for controlling the operations of the plural number of the paper transporting units, wherein the drive control means includes first means operating such that when any of the in-unit paper sensing means located in the first paper transporting unit detects a paper transport trouble, the first means stops the paper transporting operation of the second paper transporting unit in response to a sensing signal indicative of the presence of a paper from the unit-to-unit paper sensing means, and second means stops the paper transporting operation of the first paper transporting unit upon the stop of the paper transporting operation of the second paper transporting unit, and drives the first paper transporting unit to move the paper a predetermined distance in the direction that is reverse to the normal direction. With such a construction, the paper is easily removed from the first paper transporting unit.

The second invention as set forth in aspect 2 specifies the image forming apparatus of the first invention such that the first paper transporting unit includes one or a plural number of photoreceptor drums and an image transferring belt, and the second paper transporting unit is a fixing unit for processing the paper having an image already transferred thereonto, which is delivered from the first paper transporting unit 30, for fixing the image thereonto.

The third invention as set forth in aspect 3 defines an image forming apparatus comprising: a plural number of paper transporting units including a first paper transporting unit 30 forming an image transferring means, a second paper transporting unit 31 forming a fixing unit for processing the paper having an image already transferred thereonto, which is delivered from the first paper transporting unit 30, for fixing the image thereonto, and a third paper transporting unit 32 forming a paper feeding means for feeding papers to the first paper transporting unit 30; in-unit paper sensing means (64 to 67) located in the first paper transporting unit 30; unit-to-unit paper sensing means 68 located between the first and second paper transporting units (30, 31) ; and drive control means 84 for controlling the operations of the plural number of the paper transporting units, wherein the drive control means 84 includes first means operating such that when any of the in-unit paper sensing means (64 to 67) located in the first paper transporting unit 30 detects a paper transport trouble, the first means stops the paper transporting operation of the second paper transporting unit in response to a sensing signal indicative of the presence of a paper from the unit-to-unit paper sensing means 68 located between the first and second paper transporting units (30, 31), second means stops the paper transporting operation of the first paper transporting unit 30 upon the stop of the paper transporting operation of the second paper transporting unit 31, and drive the first paper transporting unit 30 to move the paper a predetermined distance in the direction that is reverse to the normal direction, and third means operating such that when the unit-to-unit paper sensing means 63 located between the first paper transporting unit 30 and the third paper transporting unit 32 detects a paper transport trouble, the third means pushes the paper into the first paper transporting unit 30. (Reference numerals were attached to the key components for clarifying the correspondence of these key components and those in the embodiment.)

The fourth invention as set forth in aspect 4 specifies the image forming apparatus such that the paper sensing means in the first paper transporting unit is disposed downstream of the image transferring means on the paper transporting path.

The fifth invention as set forth in aspect 5 specifies the image forming apparatus such that the paper sensing means in the first paper transporting unit is disposed upstream of a cleaning member located on the photoreceptor drum.

Any of the first to fifth inventions may have the following constructions:

1) The transporting operation of the second paper transporting unit is stopped by removing a pressure between the paired fixing rolls of the fixing unit.

2) A time from the detection of the paper transport trouble by the paper sensing means of the first paper transporting unit till the detection of presence or absence of the paper between the first and the second paper transporting units, is elongated.

3) A time from an instant that the presence of the paper is detected on the basis of the information from the paper sensing means for detecting the presence or absence of the paper between the first and the second paper transporting units when the paper sensing means of the first paper transporting unit detects a paper transport trouble till the paper transport by the second paper transporting unit is stopped, is elongated.

4) A time from an instant that the paper transport by the second paper transporting unit is stopped till the paper transport by the first paper transporting unit is stopped, is elongated.

5) A time to turn the first paper transporting unit in the direction that is reverse to a normal paper transport direction after the paper transport by the first paper transporting unit is determined by a count value of a timer contained in a CPU in an arithmetic/logic unit forming the control means.

6) A time to turn the first paper transporting unit in the direction that is reverse to a normal paper transport direction after the paper transport by the first paper transporting unit is determined by information derived from the paper sensing means for detecting a paper transport state.

7) During a time to turn the first paper transporting unit in the direction that is reverse to a normal paper transport direction after the paper transport by the first paper transporting unit, the first paper transporting unit moves the paper in the reverse direction till the leading edge of the paper is moved back to the upstream image transporting means.

8) Means for judging the size of the paper whose transport is abnormal and means for storing the location of the transport trouble are included. The information derived from those means are used for controlling the operation of the third paper transporting unit located upstream of the first paper transporting unit on the paper transporting path.

9) Means for detecting presence or absence of the paper being transported after the jammed paper is included. The information derived from the means are used for controlling the operation of the third paper transporting unit located upstream of the first paper transporting unit on the paper transporting path.

10) Means for judging whether the surface of the jammed paper having been subjected to the image transferring process is the first side thereof or the second side. The information derived from the means are used for controlling the operation of the third paper transporting unit located upstream of the first paper transporting unit on the paper transporting path.

11) The first paper transporting unit is removably set to the apparatus body.

12) The plural number of the image transferring means of the first paper transporting unit are removably set to the plural number of the photoreceptor.

13) The first and the second paper transporting units are removably set to the apparatus body.

To achieve the above object, there is provided an image forming apparatus comprising:

a photoreceptor on which a toner image defined by image information is formed;

an endless image transferring belt for transporting a paper to a toner image transferring stage with its turn, the image transferring belt being disposed in a state that the image transferring belt may be brought into contact with the photoreceptor and separated from the photoreceptor; and paper sensing means, disposed along a paper transporting paths including the image transferring belt, for detecting a jam trouble on the paper transporting path, wherein when the paper sensing means detects a jam, the belt-like image recording medium holding member is stopped, and detached from the photoreceptor, and in this state, a user is directed to remove a jammed paper from the image forming apparatus.

When a POP jam or another type of jam happens in the image forming apparatus, some of the paper transporting units are removably set to the apparatus body so as to allow a user to easily remove a jammed paper. For example, such units that in setting and removing the photoreceptor unit to and from the apparatus, the setting/removal work is likely to damage the photoreceptor, are frequently constructed so as to reject the access thereto by a user.

Where it is impossible to simultaneously remove a plural number of the units and a paper lie on those units, if only one of the units is pulled out, the paper will be torn, a part of the paper will be left in the apparatus, or it will damage the apparatus. In such a case, the image forming apparatus of the invention determines the operations of the units on the basis of the information of the paper position between the units or in the unit, to thereby allow the user to remove the papers being transported before and after the POP jammed paper without damaging the apparatus.

In the invention, when the paper sensing means detects a jam on the paper transporting path, the belt-like image recording medium holding member is stopped, and detached from the photoreceptor, and in this state, a user is directed to remove a jammed paper from the image forming apparatus. Therefore, even if the apparatus suffering from the jam is left without removing the jam for a long time, the charge do not move from the belt-like image recording medium holding member to the photoreceptor, so that an abnormal potential history is not formed in the photoreceptor. Further, the apparatus stops its operation in a state that the photoreceptor is separated from the image recording medium holding member. If the apparatus suffering from the jam is left without removing the jam for a long time, the parting oil is not transferred from the surface of the image recording medium holding member to the photoreceptor.

In the construction of the first invention, the first paper transporting unit includes in-unit paper sensing means for detecting presence or absence of the transport paper in the first paper transporting unit. Further, unit-to-unit paper sensing means is provided between the first and the second paper transporting units, and detects the presence or absence of a paper lying on both the paper transporting units.

The drive control means controls the operation of the plural number of the paper transporting units, to thereby position the paper at a location where the jammed paper is easily removed. When and of the in-unit paper sensing means located in the first paper transporting unit detects a paper transport trouble, the drive control means stops the paper transporting operation of the second paper transporting unit in response to a sensing signal indicative of the presence of a paper from the unit-to-unit paper sensing means. And the drive control means stops the paper transporting operation of the first paper transporting unit upon the stop of the paper transporting operation of the second paper transporting unit, and drives the first paper transporting unit to move the paper a predetermined distance in the direction that is reverse to the normal direction. As a result, the paper may easily be removed from the first paper transporting unit.

In the construction of the second invention as set forth in aspect 2, in the image forming apparatus of the first invention, the first paper transporting unit includes one or a plural number of photoreceptor drums and an image transferring belt, and the second paper transporting unit is a fixing unit for processing the paper having an image already transferred thereonto, which is delivered from the first paper transporting unit 30, for fixing the image thereonto. With such a construction, when a paper undergoing the image transferring process or a paper having a toner image transferred thereto and going to the fixing unit is jammed, the jammed paper can easily be removed.

In the construction of the third invention as set forth in aspect 3, the first paper transporting unit includes in-unit paper sensing means for detecting presence or absence of a paper being transported in the unit. Further, unit-to-unit paper sensing means is provided between the first and the second paper transporting units, and detects the presence or absence of a paper lying on both the paper transporting units.

The drive control means controls the operation of the plural number of the paper transporting units, to thereby position the paper at a location where the jammed paper is easily removed. When any of the in-unit paper sensing means located in the first paper transporting unit detects a paper transport trouble, the drive control means stops the paper transporting operation of the second paper transporting unit in response to a sensing signal indicative of the presence of a paper from the unit-to-unit paper sensing means. And the drive control means stops the paper transporting operation of the first paper transporting unit upon the stop of the paper transporting operation of the second paper transporting unit, and drives the first paper transporting unit to move the paper a predetermined distance in the direction that is reverse to the normal direction. Further, when the unit-to-unit paper sensing means 63 located between the first paper transporting unit 30 and the third paper transporting unit 32 detects a paper transport trouble, the drive control means pushes the paper into the first paper transporting unit 30. As a result, the paper may easily be removed from the first paper transporting unit.

In the construction of the fourth invention as set forth in aspect 4, the paper sensing means in the first paper transporting unit is disposed downstream of the image transferring means on the paper transporting path. The paper sensing means detects a jam of the type in which the paper clings to the photoreceptor, viz., the POP jam. In the fifth invention as set forth in aspect 5, the paper sensing means in the first paper transporting unit is disposed upstream of a cleaning member located on the photoreceptor drum. With this, the photoreceptor drum is stopped before the jammed paper reaches the cleaning member.

The operations of the following constructions (1) to (13) based on any of the first to fifth inventions are as follows:

1) The transporting operation of the second paper transporting unit is stopped by removing a pressure between the paired fixing rolls of the fixing unit. Therefore, no jam will occur at the fixing rolls.

2) A time from the detection of the paper transport trouble by the paper sensing means of the first paper transporting unit till the detection of presence or absence of the paper between the first and the second paper transporting units, is elongated. With this, a transport time different between the image transferring belt and the fixing rolls may be adjusted.

3) A time from an instant that the presence of the paper is detected on the basis of the information from the paper sensing means fox detecting the presence or absence of the paper between the first and the second paper transporting units when the paper sensing means of the first paper transporting unit detects a paper transport trouble till the paper transport by the second paper transporting unit is stopped, is elongated. With this, a transport time different between the image transferring belt and the fixing rolls may be adjusted.

4) A time from an instant that the paper transport by the second paper transporting unit is stopped till the paper transport by the first paper transporting unit is stopped, is elongated. Therefore, no jam will occur at the fixing rolls.

5) A time to turn the first paper transporting unit in the direction that is reverse to a normal paper transport direction after the paper transport by the first paper transporting unit is determined by a timer contained in a CPU in an arithmetic/logic unit forming the control means.

6) A time to turn the first paper transporting unit in the direction that is reverse to a normal paper transport direction after the paper transport by the first paper transporting unit is determined by information derived from the paper sensing means for detecting a paper transport state.

7) During a time to turn the first paper transporting unit in the direction that is reverse to a normal paper transport direction after the paper transport by the first paper transporting unit, the first paper transporting unit moves the paper in the reverse direction till the leading edge of the paper is moved back to the upstream image transporting means.

8) The information derived from means for judging the size of the paper whose transport is abnormal and means for storing the location of the transport trouble, are used for controlling the operation of the third paper transporting unit located upstream of the first paper transporting unit on the paper transporting path.

9) Means for detecting presence or absence of the paper being transported after the jammed paper is included. The information derived from the means are used for controlling the operation of the third paper transporting unit located upstream of the first paper transporting unit on the paper transporting path.

10) The information from means for judging whether the surface of the jammed paper having been subjected to the image transferring process is the first side thereof or the second side, are used for controlling the operation of the third paper transporting unit located upstream of the first paper transporting unit on the paper transporting path.

11) The first paper transporting unit is removably set to the apparatus body. This makes it easy to remove a jammed paper.

12) The plural number of the image transferring means of the first paper transporting unit are removably set to the plural number of the photoreceptor. This makes it easy to remove a jammed paper.

13) The first and the second paper transporting units are removably set to the apparatus body. This makes it easy to remove a jammed paper.

DETAILED DESCRIPTION OF THE PREFERRED EMBODIMENTS

The preferred embodiments of the present invention will be described with reference to the accompanying drawings.

Figure 1:
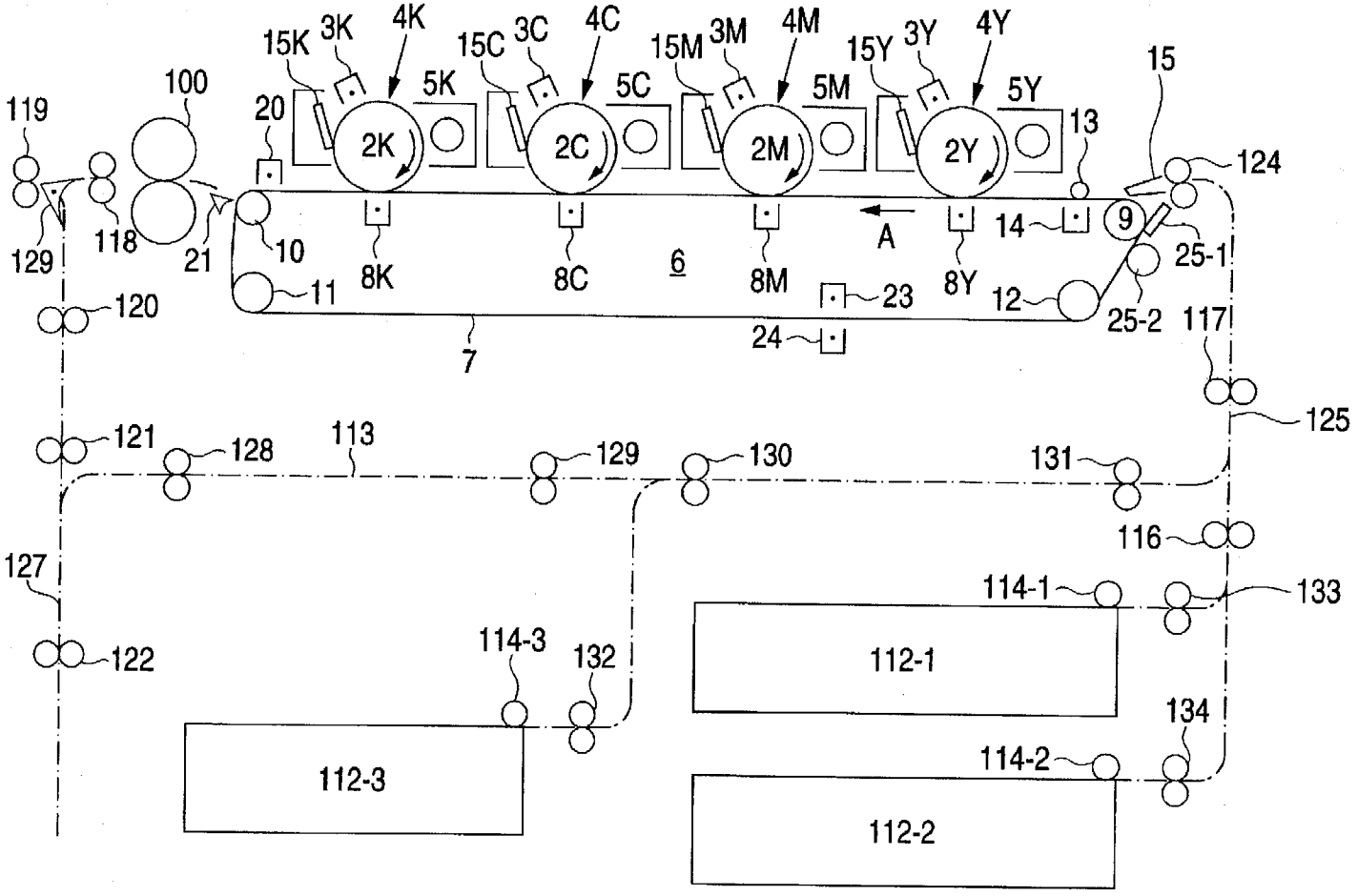
FIG. 1 is a diagram showing an overall construction of an embodiment of an image forming apparatus according to the present invention.

FIG. 1 is a diagram showing an overall construction of an embodiment of an image forming apparatus according to the present invention. In the figure, 2Y, 2M, 2C and 2K designate photoreceptor drums of yellow (Y), magenta (M), cyan (C) and black (K); 3Y, 3M, 3C and 3K, primary chargers; 4Y, 4M, 4C and 4K, exposure beams; 5Y, 5M, 5C and 5K, developing units; 6, an image transferring unit; 7, an image transferring belt; 8Y, 8M, 8C and 8K, image transferring chargers; 9, a drive roll; 10, 11 and 12, follower rolls; 13, an electrode; 14, an attraction charger; 15, a guide member; 15Y, 15M, 15C and 15K, cleaning members for the photoreceptor drums; 20, a peeling-off charge eraser; 21, a peeling-off pawl; 23, an inner charge-erasing charger; 24, an outer charge-erasing charger; and 25-1 and 25-2, transferring belt cleaning means (cleaning members).

Also in the figure, reference numeral 100 designates a fixing unit (including a fixing roll pair); 112-1 to 112-3, paper trays; 113, a paper transporting path for both-side printing; 114-1 to 114-3, and 120 to 122, transporting rolls; 116 to 119, paper-discharge transporting roll pairs; 124, a paper feeding roll (registration or regi. roll); 125, a transporting path joint; 127, a reversing point; 128 to 134, transporting rolls; and 129, a movable paper guide.

In the figure, in the image forming apparatus, the photoreceptor drums 2Y, 2M, 2C and 2K of yellow (Y), magenta (M), cyan (C) and black (K) are arrayed at given spatial intervals in this order, from the right side in the figure, i.e., a location closer to the regi. roll 124, to the left side. The primary chargers 3Y, 3M, 3C and 3K are disposed in proximity to the surface of the photoreceptor drums. 2Y, 2M, 2C and 2K, respectively. The primary chargers 3Y, 3M, 3C and 3K uniformly charge the surfaces of the photoreceptor drums 2Y, 2M, 2C and 2K associated therewith up to a specific potential level between −800 V and +800 V, for example, respectively.

Exposure means, such as laser beam exposure devices, are disposed downstream (when viewed in the rotational direction) of the primary chargers 3Y, 3M, 3C and 3K located in proximity to the outer surface of the photoreceptor drums 2Y, 2M, 2C and 2K, and scan the surfaces of the photoreceptor drums 2Y, 2M, 2C and 2K with the exposure beams 4Y, 4M, 4C and 4K emitted therefrom. The developing units 5Y, 5M, 5C and 5K are disposed downstream (when viewed in the rotational direction) of the scanning regions by the exposure beams 4Y, 4M, 4C and 4K, which are located close to the outer surface of the photoreceptor drums 2Y, 22, 2C and 2K.

The exposure beams 4Y, 4M, 4C and 4K emitted from the exposure means are modulated by an optical image color separated or an optical image equivalent to the former, and form electrostatic latent images on the photoreceptor drums 2Y, 2M, 2C and 2K. The developing units 5Y, 5M, 5C and 5K develops the electrostatic latent images into toner images, by using toner. The image transferring unit 6 is disposed under the photoreceptor drums 2Y, 2M, 2C and 2K. The image transferring unit 6 includes the endless transferring belt 7 of a predetermined length that is disposed in contact with the photoreceptor drums 2Y, 2M, 2C and 2K, and the image transferring chargers 8Y, 8M, 8C and 8K disposed in opposition to the image transferring positions as the lowest positions of the photoreceptor drums 2Y, 2M, 2C and 2K.

The transferring belt 7 consists of a dielectric transporting sheet that is formed by using a resin film made of polyethylene terephthalate (PET), polycarbonate (PC), polyvinylidene fluoride (PVDF), or the like. The transferring belt 7 is stretched between the drive roll 9 and at least one follower roll (the rolls 10 to 12 in FIG. 1) at a preset tension. The drive roll 9 is coupled with a transferring belt drive source (not shown) of good constant speed performance, which is exclusively used for driving the transferring belt. The transferring belt 7 thus put on the drive roll and the follower rolls is circulatively turned, by the drive roll 9, around the rolls in the direction of an arrow A, or counterclockwise.

The image transferring chargers 8Y, 8M, 8C and 8K consist of corona chargers, respectively. Voltages, which are different from one another but within the range from +4.2 kV to +12.0 kV, are applied to those chargers, respectively. The total discharging current of those chargers is within the range from +50 μA to +2000 μA. Part of the transfer current flows into the photoreceptor drums 2Y, 2M, 2C and 2K, so that the toner images are transferred from the photoreceptor drums 2Y, 2M, 2C and 2K onto an image recording medium (paper) being attracted to the transferring belt 7.

Figure 2:
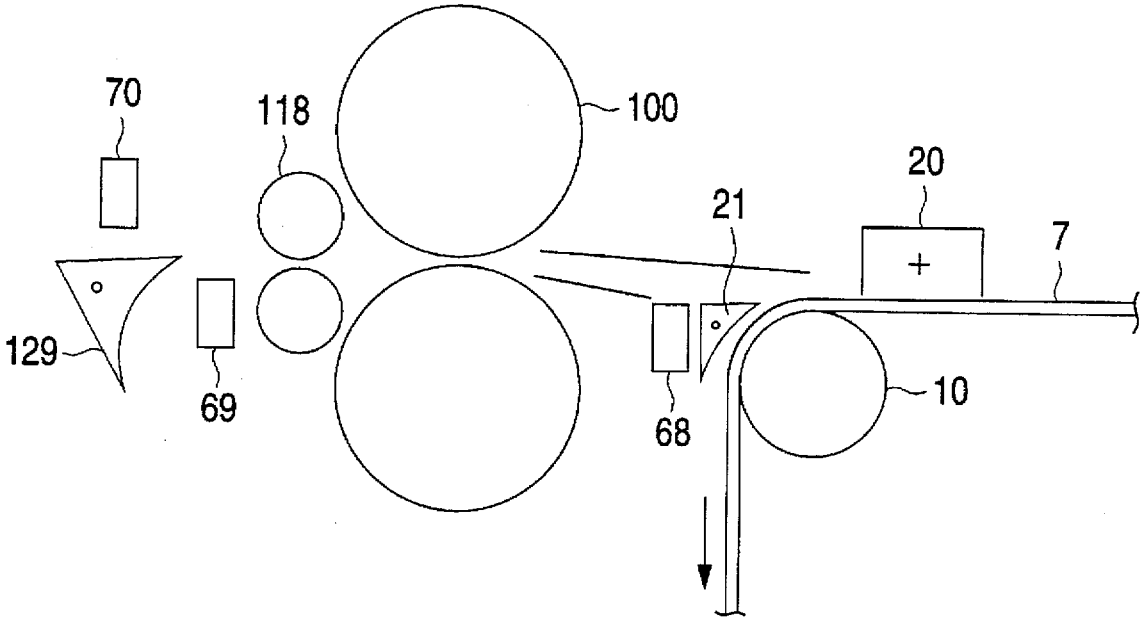
FIG. 2 is a diagram for explaining the construction of a paper peeling-off means and the image transferring unit in the image forming apparatus according to the present invention.

Disposed between the drive roll 9 for the transferring belt 7 and the first image transferring charger 8Y are the attraction charger 14 for attractively putting a paper onto the transferring belt 7, the guide member 15 for guiding the image recording medium to the transferring belt 7 so as to be placed in opposition to the attraction charger 14, and the electrode 13 located in opposition to the attraction charger 14. FIG. 2 is a diagram for explaining the construction of a paper peeling-off means and the image transferring unit. In the figure, reference numerals 68 and 69 designate paper sensors, and like reference numerals are used for designating like portions in FIG. 1.

The peeling-off means for peeling the paper off the transferring belt 7 is disposed downstream of the last image transferring charger 8K located in proximity to the transferring belt 9. The peeling-off means includes a peeling-off roll, the peeling-off charge eraser 20, and the peeling-off pawl 21. The peeling-off roll is used for peeling the paper off the transferring belt 7 by making use of a "buckling" of the paper caused by bending the transferring belt 7, and the follower roll 10 is used for the peeling-off roll. The peeling-off charge eraser 20 is disposed outside the transferring belt 7 in the vicinity of the follower roll 10, while facing the transferring belt 7. The peeling-off pawl 21 is disposed close to the peeling-off position and outside the transferring belt 7.

Outside the transferring belt 7, the inner charge-erasing charger 23 and the outer charge-erasing charger 24, which cooperatively form charge erasing means for erasing the charge on the transferring belt 7, are oppositely disposed on both sides of the transferring belt 7 and downstream of the last image transferring charger 8K. Disposed between the charge erasing means for erasing the charge on the transferring belt 7 and the attraction charger 14 are transferring belt cleaning means 25-1 and 25-2.

Figure 3:
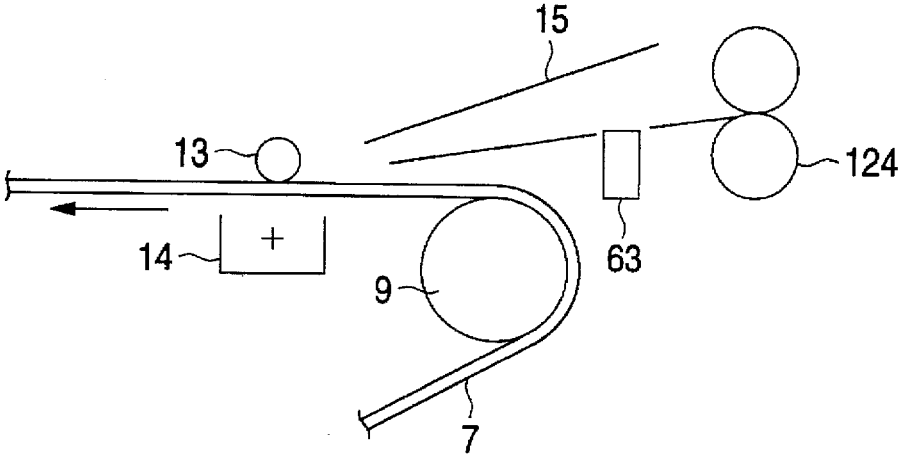
FIG. 3 is a diagram for explaining the construction of paper supplying means for supplying papers to the transferring belt in the image forming apparatus according to the present invention.

FIG. 3 is a diagram for explaining the construction of paper supplying means for supplying papers to the transferring belt. In the figure, reference numeral 63 designates a paper sensor, and like reference numerals are used for designating like portions in FIG. 1. A paper is pulled out of the paper tray 112, viz., one of the paper trays 112-1 to 112-3 each containing a stack of papers, and led to the guide member 15, through a paper supply path extended from the paper tray. Then, the paper is guided to the transferring belt 7 by the guide member 15 and electrostatically attracted onto the transferring belt 7 by the attraction charger 14. Roll pairs (114, 116, 117, and 124), which have respectively drive sources, are disposed at fixed spatial intervals along the paper supply paths. The timing of the arrival of the paper being transported at a desired speed at the transferring belt 7 can be adjusted by the rolling pairs.

The paper electrostatically attracted onto the transferring belt 7 is transported and reaches the transferring position of the photoreceptor drum 2Y of yellow (Y). At this position, a toner image of yellow (Y) is transferred onto the paper, from the photoreceptor drum 2Y. Then, the paper is further transported by the transferring belt 7, and a toner image of magenta (M) is transferred from the transferring position of the photoreceptor drum 2M onto the paper. Subsequently, a toner image of cyan (C) and a toner image of black (K) are superposedly transferred onto the paper in successive order. In this way, the full color images of four colors are superposedly transferred onto the paper.

Following the operation of superposedly transferring the full color images, the paper is electrostatically or mechanically peeled off the transferring belt 7 by the cooperative operations of the peeling-off roll (follower roll) 10, the peeling-off charge eraser 20, the peeling-off pawl 21, and the like. And the toner image is transported to the fixing unit 100 for fixing the toner image on the paper by heat or pressure. The paper emanating from the fixing stage is discharged to exterior (outside machine) by the paper-discharge transporting rolls 118 and 119, when the machine is in a one-side print mode for printing an image on only one side of the paper. In a both-side print mode, the paper leaving the paper-discharge transporting roll 118 is guided, by the movable paper guide 129, to the paper transporting path for both-side printing.

Figure 4:
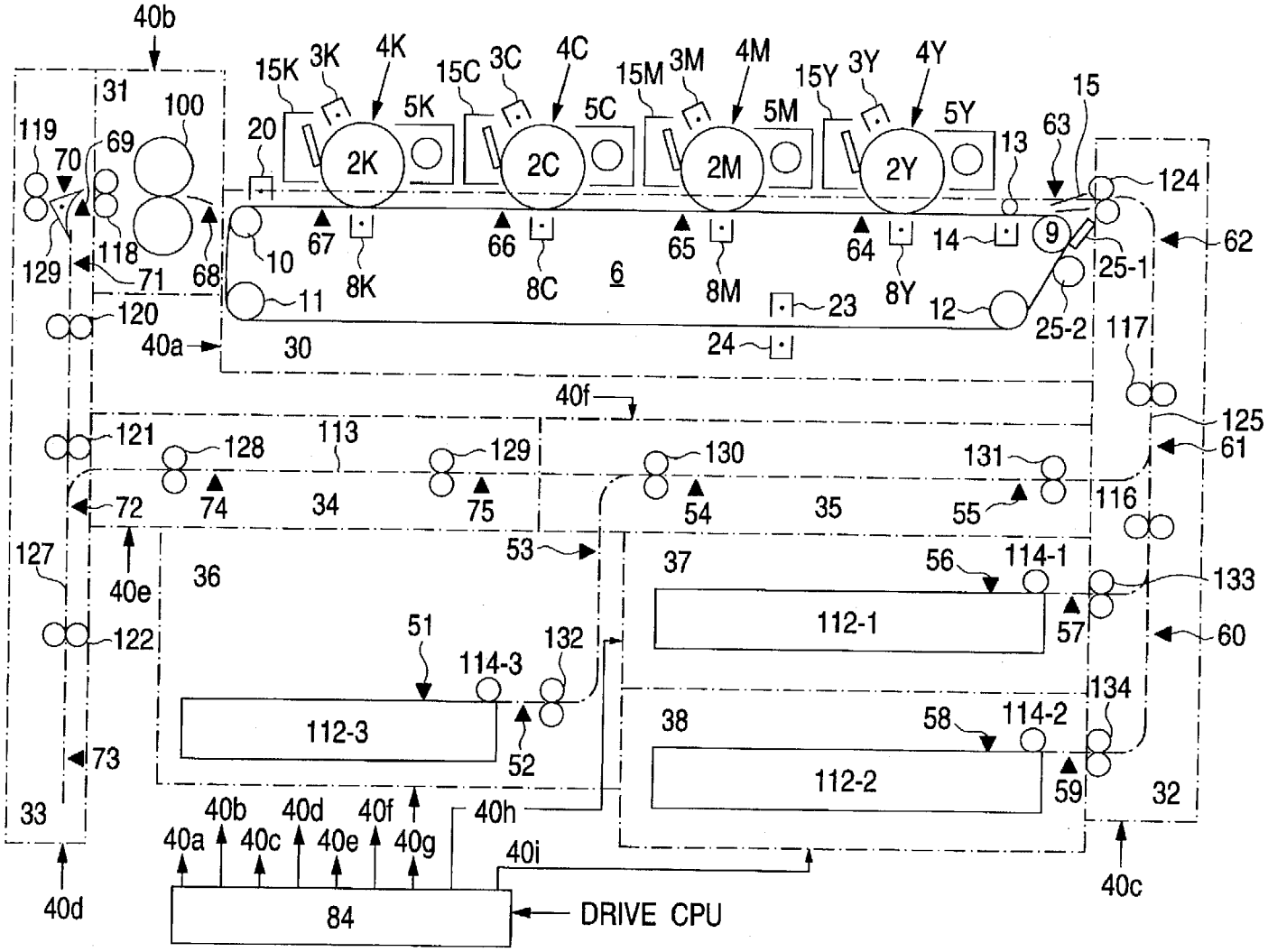
FIG. 4 is a diagram showing a layout of paper sensors in the image forming apparatus shown in FIG. 1.

The paper is transported downward in the drawing by the transporting rolls 120, 121 and 122 on the paper transporting path for both-side printing. After passing the reversing point 127, it is temporarily stopped and then transported in the reverse direction to the paper transporting path 113 for both-side printing, and moves forward along the normal paper transporting path. In this way, the both-side printing of the full color images is automatically carried out.

Where the paper is transported on such complicated paper transporting paths, it is common practice to use a means which detects a symptom of a paper transport trouble caused by a state of the paper or a state of the image forming apparatus, and minimizes the occurrence of unwanted situations; for example, the apparatus breaks down, the paper is torn, and so on. FIG. 4 is a diagram showing a layout of paper sensors in the image forming apparatus shown in FIG. 1. In the figure, reference numeral 30 designates a first paper transporting unit including the image transferring unit; 31, a second paper transporting unit including the fixing unit; 32, a third paper transporting unit including the paper supplying means; 33, a fourth paper transporting unit including paper reversing means; 34, a fifth paper transporting unit including the both-side printing paper transporting path; 35, a sixth paper transporting unit including the paper transporting paths led from the paper trays; 36, 37 and 38, seventh, eighth and ninth paper transporting units; 51 to 75, paper sensors; and 84, a drive control means (paper transport control device). In the figure, like reference numerals are used for designating like portions in FIG. 1.

As shown, paper information, which are derived from the paper sensors, are compared with information of a judging means incorporated in advance into a central processing unit (machine CPU). The judging means judges as to whether the paper transport is normal or abnormal. If it is abnormal, the judging means emergently stops the whole apparatus (all of the units) or a part (one or a more number of the units) of the apparatus, to thereby minimize the occurrence of unwanted situations; for example, the apparatus breaks down, the paper is torn, and so on.

The information, which are derived from the paper sensors 51 to 75 disposed at different positions in the image forming apparatus, have various sensing modes in accordance with the sensors positions. It is assumed that the sensing means consists of a photo sensor, and that when the paper is present, it produces a signal of a high level (H), and when the paper is absent, it produces a signal of a low level (L). In a sensing mode 1, if the output signal level of the sensor is not switched from L to H till the reference time, it is occasionally judged that the paper transport is abnormal. This is the case where the leading edge of the paper fails to reach the reference position till the reference time. From this, it is judged that the cause of the paper transport trouble is located somewhere upstream of the sensing position.

In a sensing mode 2, the output signal level of the sensor is not switched from H to L till the reference time, it is occasionally judged that the paper transport is abnormal. This is the case where the trailing edge of the paper fails to leave the sensor position till the reference time. From this, it is judged that the cause of the paper transport trouble is located downstream of the sensor position and within a distance shorter than the length of the paper. In a sensing mode 3, if the output signal level of the sensor is switched from L to H irrespective of the specific time, it is occasionally judged that the paper transport is abnormal. This is the case where the sensor senses a motionless part of the paper. In this case, it is clear that the paper transport trouble is located at this part.

In FIG. 4, within the loop of the transferring belt 7, the paper sensors 64 to 67 are located, as in-unit paper sensors, just downstream of the image transferring chargers 8Y, 8M, 8C and 8K. The sensors 64 to 67 are provided for detecting a called POP (paper on photoreceptor) jam. When the paper, which is electrostatically attracted onto the transferring belt 7, pass through the transfer electric fields formed by the image transferring chargers 8Y, 8M, 8C and 8K, the peeling-off discharging phenomena take place, and the paper will cling onto the photoreceptor drums 2Y, 2M, 2C and 2K (POP jam).

In this case, the sensing mode 1 is used to check whether the paper transport is normal or abnormal. The phenomenon that the paper will coil round the photoreceptor drums 2Y, 2M, 2C and 2K may also be detected in a manner that the paper sensors are disposed in proximity to the photoreceptor drums 2Y, 2M, 2C and 2K. In this case, the sensing mode 3 is used to check whether the paper transport is normal or abnormal.

Figure 5:
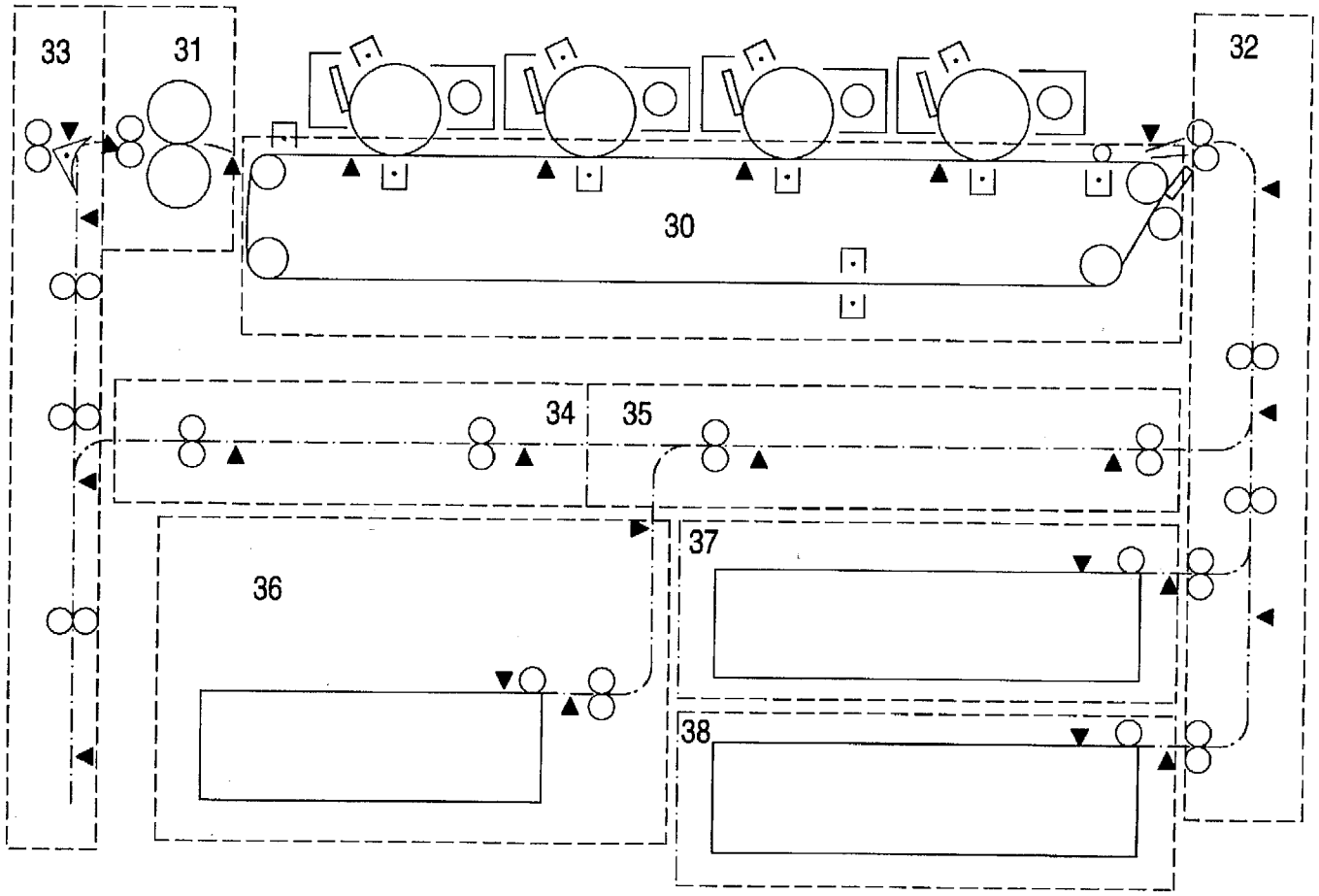
FIG. 5 is a diagram showing a unit arrangement when the image forming apparatus is expressed in the form of a composite system including a plural number of the paper transporting units.

The paper transporting units in the image forming apparatus of the present embodiment will be described. FIG. 5 is a diagram showing a unit arrangement when the image forming apparatus is expressed in the form of a composite system including a plural number of the paper transporting units. In the figure, like reference numerals are used for designating like portions in FIGS. 1 to 4.

In the figure, a first paper transporting unit 30 consists of a section including the image transferring unit 6, and the second paper transporting unit 31 consists of a section including the fixing unit 100 located downstream of the first paper transporting unit 30 on the paper transporting path. The third paper transporting unit 32 consists of a section including an image recording medium feeding unit (paper supplying unit) located upstream of the first paper transporting unit 30 on the paper transporting path.

The fourth paper transporting unit 33 consists of a portion of the transporting path for both-side printing where the image recording medium is removable from the left side (when viewed from the front of the apparatus). The fifth paper transporting unit 34 is formed by a portion where the paper is removed from the front of the apparatus. The portions of three paper supplying units, respectively, form the seventh paper transporting unit 36, the eighth paper transporting unit 37, and the ninth paper transporting unit 38. The sixth paper transporting unit 35 consists of a portion of the paper transporting path for both-side printing, which includes a joint of the paper transporting path for both-side printing and the paper transporting path led from the paper supplying unit (seventh paper transporting unit 36).

In a case where the paper transport trouble happens, and the whole apparatus or a part of the apparatus is emergently stopped in response to information derived from the paper sensor or sensors to minimize the occurrence of unwanted situations, for example, break-down of the apparatus, the image recording medium 17 being torn, and like, the papers are left in most of the units during the operation of a plural-copies both-side print mode. For removing those papers left in the units, the seven paper transporting units 30, 31, 34 to 37, and 39, except the third paper transporting unit 32 and the fourth paper transporting unit 33, are assembled into the apparatus body such that those units can be drawn out of the apparatus body from the front side of the apparatus. Incidentally, the third paper transporting unit 32 allows the paper left therein to be pulled out from the right side (when viewed from the front side of the apparatus) of the apparatus. The fourth paper transporting unit 33 allows the paper left therein to be pulled out from the left side (when viewed from the front side of the apparatus) of the apparatus.

In the image forming apparatus for forming a full color image, it is necessary to accurately position the image transferring unit 6 of the first paper transporting unit relative to the fixing unit 100 of the second paper transporting unit. For this reason, it is necessary to simultaneously set the two paper transporting units to the apparatus body and simultaneously remove these units from the apparatus body. However, where these units are accurately positioned to the apparatus body within the apparatus, the units may be separately set to the apparatus body and separately removed from the apparatus body.

In the image forming apparatus, the photoreceptor drums 2Y, 2M, 2C and 2K which do not concern the paper transport by nature, and the units of the image forming members disposed around the photoreceptor drums are removably set into the apparatus body. However, it is originally required to removably assemble the photoreceptor drums 2Y, 2M, 2C and 2K and the units into the apparatus body since the maintenance necessitates the replacement of those drums, developer, and the image forming members associated with the drums.

The photoreceptor drums 2Y, 2M, 2C and 2K hold electrostatic latent images formed thereon, and the latent images are developed with developer. By convention, the image forming apparatus is designed so as to allow only a specific person who can maintain the apparatus to make an access to those drums. In other words, the apparatus is designed so as to reject the access by those ordinary persons who remove only the papers jammed at the photoreceptor drums 2Y, 2M, 2C and 2K. In connection with this, it is noted that the image forming apparatus of the present embodiment allows all of the units to individually be set to and removed from the apparatus body.

The arrangement of the paper transporting units and the paper sensors will be described. As already referred to, when the paper transport trouble happens during the operation of a plural-copies both-side print mode, the whole apparatus or a part of the apparatus is emergently stopped to minimize the occurrence of unwanted situations, such as the break-down of the apparatus, and the image recording medium being torn. In this case, it is necessary to specify the present positions of all of the papers staying in the apparatus, i.e., the transport trouble paper and the papers being transported before and after the former.

For this reason, as shown also in FIG. 5, the paper sensors are provided at the inlet and the outlet of each of the paper transporting units. When a paper stops lying on a plural number of the paper transporting units, the user's operation of removing only one of the transporting units sometimes fails to remove the paper. To avoid this, it is necessary to vary the timing of stopping a part of the apparatus in accordance with information from the paper sensors so that the paper does not stop on the plural number of the paper transporting units.

When the POP jam occurs, the image forming apparatus of the present embodiment operates in the following ways. It is supposed that the paper sensor 65 shown in FIG. 4 detects a paper transfer trouble during the operation of the successive both-side print mode, for example, with the unit arrangement of the image forming apparatus, the paper sensors, and the control system for controlling the papers left in the apparatus at the time of the paper transport trouble.

The fact that the paper transfer trouble happens within the loop of the transferring belt 7 as shown in FIG. 4 implies that the leading edge of the paper has failed to reach the paper sensor 65 within a reference time as the result of the POP jam at the photoreceptor drum 2M. In the successive print mode, a plural number of papers are present in the image forming apparatus in a state that these papers are spaced from each other at a fixed distance.

FIGS. 6A to 6D are diagrams showing the distances each between the adjacent papers in some typical arrays of papers of different sizes, which are arrayed in the paper transporting direction in the image forming apparatus of the present embodiment. In the present embodiment, the papers are spaced under the following rules in the successive print mode. Where a dielectric film made of any of the materials as mentioned above is used for the transferring belt, a belt with a seam part, formed by jointing both ends of a plate-like dielectric film by an ultrasonic welding method, for example, is usually used for its cost reduction purpose, although it is possible to manufacture an endless belt not having a seam part, called a seamless belt.

The surface properties and the thickness of the seam part are different from those of the remaining portion of the belt, so that the seam part of the belt fails to provide an effective and proper image transferring operation. For this reason, the seam part is excluded from the image forming area of the belt.

The aim of completely prohibiting the image formation at the seam part may be achieved in a manner that a detecting means for detecting the seam part is used, and the same portion on the transferring belt is always positioned as an image forming area, or an image recording medium attracting area, on the basis of information derived from the detecting means.

When the transferring belt is much longer than the largest paper, it is possible to secure image forming areas of several papers for each turn of the transferring belt. In a case where the paper used is long enough to be recognized but shorter than the largest paper, it is possible to increase the number of the image forming areas for one turn of the transferring belt. Therefore, by increasing the number of the image forming areas, the number of prints per unit time may be increased while not changing the image forming speed.

Figure 6A:
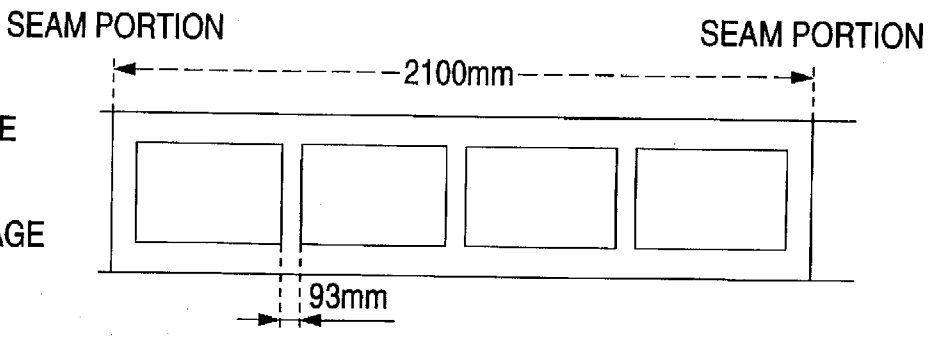
FIGS. 6A to 6D are diagrams showing the distances each between the adjacent papers in some typical arrays of papers of different sizes, which are arrayed in the paper transporting direction in the image forming apparatus of the present embodiment.
Figure 6B:
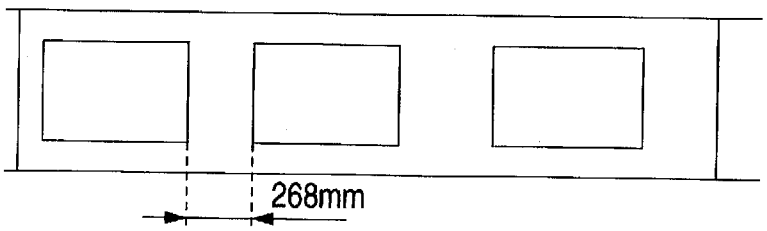

In FIG. 6A, the length of the transferring belt 7 is 2100 mm, and the length of the largest paper is 432 mm. The number of the image forming areas secured for one turn of the transferring belt is 4. In this case, 93 mm (=(2100–432×4)÷4) is the distance between the adjacent papers. In FIG. 6B, the number of the image forming areas is 3, and then the paper-to-paper distance is 268 mm (=(2100–432×3)÷3).

Figure 6C:
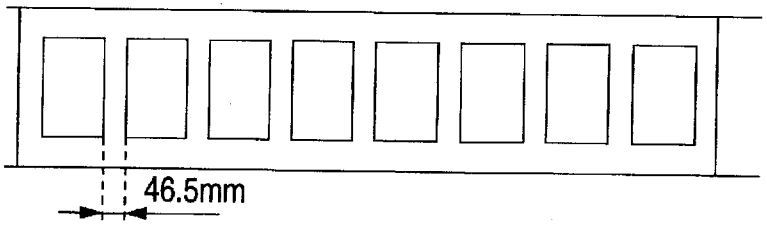
Figure 6D:
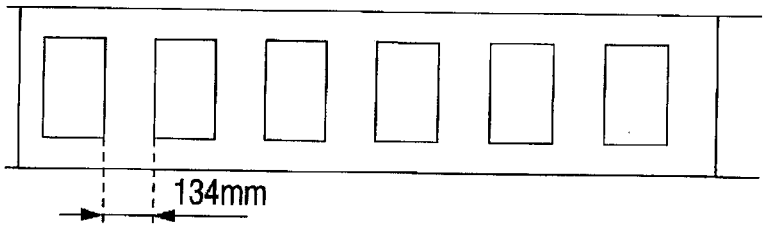

In FIG. 6C, the paper length is 216 mm. If the number of the image forming areas secured for one turn of the transferring belt is 8, the paper-to-paper distance is 46.5 mm (=(2100–216×8)÷8). In a case where the paper length is 216 mm and the number of the image forming areas secured for one turn of the transferring belt is 6, the paper-to-paper distance is 134 mm (=(2100–216×6)÷6).

FIG. 6 is a diagram showing a transferring belt that is cut along the seam part and developed into a rectangular flat sheet.

In the present embodiment, the length of the transferring belt 7 is 2100 mm. The number of image forming areas secured for one turn of the transferring belt is 8. The length of the paper is 210 mm. The distance between the adjacent papers is 52.5 mm. Further, the distance between the adjacent photoreceptor drums of those drums 2Y, 2M, 2C and 2K shown in FIG. 4 is 196 mm. The paper sensors 64 to 67 are located 49 mm downstream of the image transferring chargers 8Y, 8M, 8C and 8K, respectively.

Figure 7:
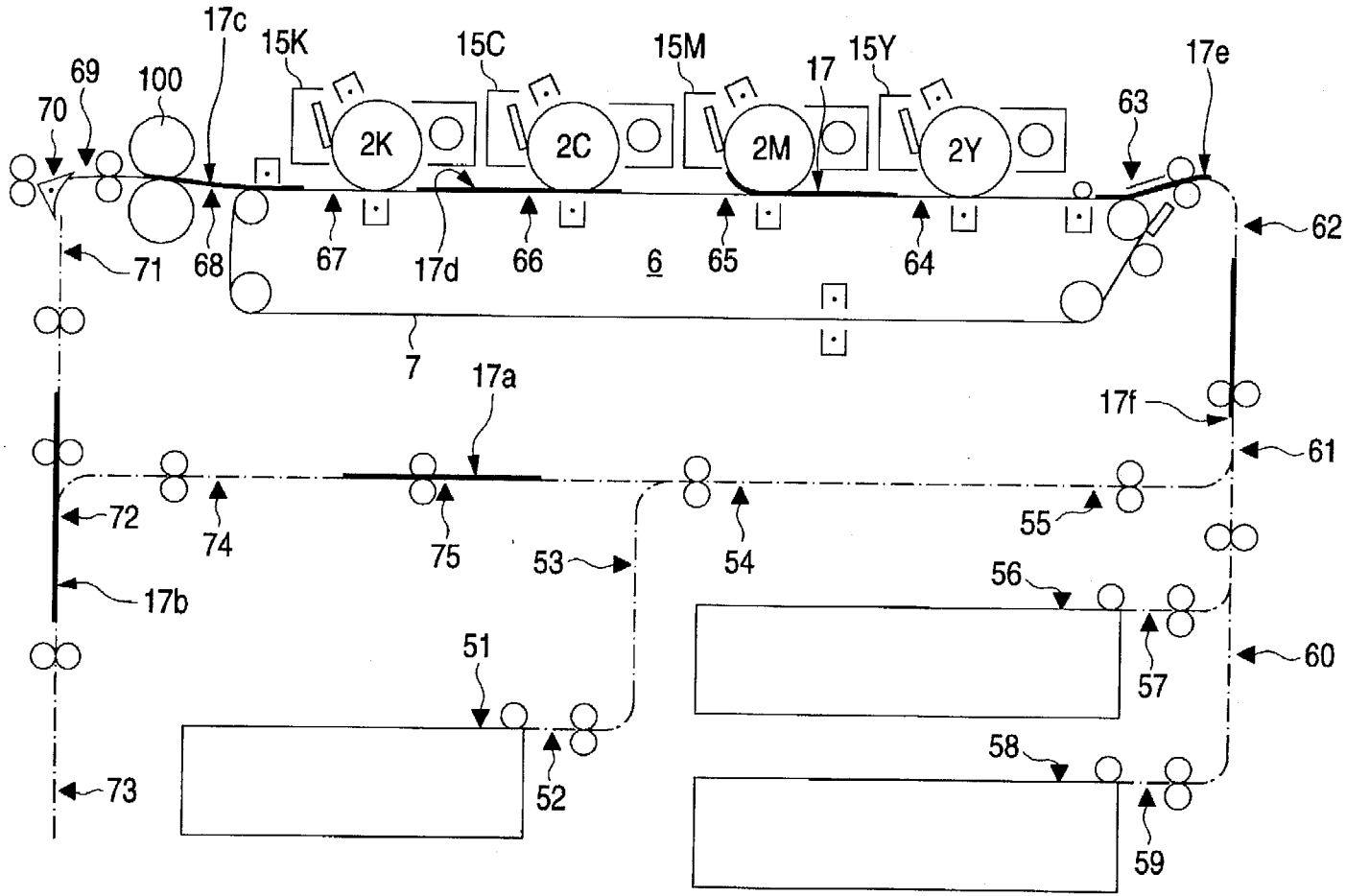
FIG. 7 is an explanatory diagram for explaining the positions of the papers located in the image forming apparatus of the present invention when a POP jam occurs.

FIG. 7 is an explanatory diagram for explaining the positions of the papers located in the image forming apparatus of the present invention when a POP jam occurs. In the figure, reference numeral 17 designates a paper (referred to as a POP jammed paper) clinging onto the photoreceptor drum 2M. Numeral 17*a* represents a fore paper (a); 17*b*, a fore paper (b); 17*c*, a fore paper (c); 17*d*, a fore-paper (d); 17*e*, a rear paper (e); and 17*f*, a rear paper (f). In the figure, four fore papers 17*a* to 17*d*, and two rear papers 17*e* and 17*f* are illustrated. However, it is evident that the number of those fore and rear papers that may be located within the apparatus is varied depending on the employed arrangement of the paper transporting units.

In the figure, when a POP jam occurs at the photoreceptor drum 2M, it is necessary to stop the photoreceptor drum 2M before the POP jammed paper 17 reaches the cleaning member 15M. When only the photoreceptor drum 2M is stopped, the jammed paper 17 is located between the transferring belt 7 and the cleaning member 15M for the photoreceptor drum 2M, while being in an uncontrollable state, because the trailing edge of the image recording medium 17 has been attracted to the image transferring belt 7.

For this reason, when the POP jam occurs, it is necessary to immediately stop at least the photoreceptor drum 2M where the jam occurs and the image transferring belt 7. In this case, the fore paper 17*d*, viz., the paper located just downstream of the POP jammed paper 17, is detected by the paper sensor 66. However, no problem arises when it is taken out from the first paper transporting unit 30.

The second fore paper (c) 17*c*, located further downstream, is blocked in its forward movement since the leading edge thereof is stopped at the nip of the fixing unit 100. In transporting an image recording medium, such as a paper, is transported from one paper transporting unit to the succeeding paper transporting unit as in the image forming apparatus of the present embodiment, the transporting speeds of these units are generally not uniform. The transporting speeds vary, and if the transporting speed of the downstream unit is higher than that of the upstream unit, a transported member, e.g., an image recording medium, is stretched, thereby leading to the paper being torn or the break-down of the transporting members forming the units.

To cope with this, the transporting speed of the downstream paper transporting unit, or the paper transporting unit including the fixing unit 100 in this case, is set to be lower than that of the image transferring belt 7. The paper is peeled off the image transferring belt 7, and is transported by the fixing unit 100, while being gradually bent. During the course of the paper transport, if the image transferring belt 7 is stopped, the fixing unit 100 must also be stopped before the bent of the paper is absorbed; otherwise, the paper will be torn or the transporting members of the unit will be broken down.

Thus, the fixing unit 100 must immediately be stopped as the photoreceptor drum and the image transferring belt are so done. The fixing unit 100 has such a construction as to reject the immediate stop thereof since it must achieve the following characteristics. The fixing unit 100 applies the physical quantities of heat and pressure to the toner on the paper, transports downstream the paper, and receives the parting agent, whereby a process of fixing a color image is stably carried out.

Such a construction that the fixing roll of the fixing unit 100 is coated with the parting agent, and the parting agent is transferred from the fixing roll to the image recording medium is frequently used for the fixing unit 100. Where the parting agent is supplied to and stabilized on the fixing roll by a web, a donor roll, or the like in the construction of the fixing unit, the reverse turn of the fixing roll leads to degradation of the performances of the parting-agent supplying/stabilizing member.

To stably fix the full color image, a pressure that is larger than that required for fixing the black/white image is required since the amount of toner used for full color image formation is larger than that for the black/white image formation. The best way to reduce the large pressure is to gradually reduce the pressure with the turn of the fixing roll. Because of the construction peculiar to the fixing unit, it is necessary to turn the fixing roll in the forward direction when the fixing pressure is reduced.

When in the thus constructed fixing unit, the fore paper is present between the image transferring belt and the fixing roll constituting the fixing unit, viz., only when the paper sensor 68 located between the paper transporting units detects the paper in FIG. 4, the image transferring belt 7 is stopped after the ability of transporting the image recording medium by the fixing roll is lost. In this case, the lowering of the paper transporting ability is determined in advance by the factors of the pressure reducing mechanism. Then, the stopping of the image transferring belt 7 may be delayed after a preset time elapses from the reception of a pressure reducing signal from the control unit. Further, the image transferring belt may be stopped in a manner that the paper transporting ability per se, for example, the speed of the fixing roll, is detected, and when the speed of the fixing roll decreases below a preset speed, the image transferring belt is stopped.

The positions of the fore papers 17*a* and 17*b* in FIG. 7, which are advancing further ahead of the fore paper 17*c*, are detected by the paper sensors 75 and 72. The driving of the transporting rolls in the fourth paper transporting unit 33, the fifth paper transporting unit 34, and the sixth paper transporting unit 35 is controlled so as to prohibit the papers from being stopped between those units. The rear paper 17*f* is also controlled in accordance with paper detection information of the paper sensor and through the driving of the transporting rolls in the third paper transporting unit 32 and other paper transporting units, so as to prohibit the paper from being stopped between those paper transporting units.

The control of the rear paper 17*e*, which is stretched out between the transporting unit (first paper transporting unit 30) detected by the paper sensor 63 and a transporting unit (third paper transporting unit 32) located upstream of the former, comes in two varieties: a first control and a second control. The first control handles the following case. Even if the image transferring belt 7 stops, the paper, as described above, cannot be stretched out between the first and the third paper transporting units 30 and 32. Accordingly, the entire rear paper 17*e* being stretched out is pushed toward the image transferring belt 7.

In this case, the rear paper 17*e* is present in the vicinity with the attraction charger 14, while being in an uncontrollable posture. At this time, if the leading edge of the paper is attracted to the image transferring belt 7, the first paper transporting unit 30 including the image transferring unit may be pulled out of the apparatus to this side. The second control of the rear paper stretched out between the first and the second transporting units 30 and 32 handles such a case where the leading edge of the paper is not attracted to the image transferring belt 7.

When the first paper transporting unit 30 is pulled out of the apparatus to this side, there are instances where the paper is left in the apparatus. This is not advisable. In a case where paper detecting information derived from the paper sensor 63 tells that when the image transferring belt 7 comes to a stop, the leading edge of the paper has been sufficiently attracted to the image transferring belt 7, the paper is pushed into the first paper transporting unit 30 by the regi. roll 124. When it is insufficiently attracted to the image transferring belt, the image transferring belt 7 is stopped and the regi. roll 124 is also stopped, whereby the movement of the pushed paper toward the first paper transporting unit 30 is minimized to set up such a state that one may make an access to the paper from the third paper transporting unit 32 for paper removal.

The conditions to stop the image transferring belt, the photoreceptor drums, the fixing unit, and the paper transporting units when a POP jam happens have been described. In this state, the leading edge of the POP jammed paper is attracted to the photoreceptor drum by a relatively strong electrostatic force. Accordingly, if the first paper transporting unit 30 including the image transferring unit is merely pulled out of the apparatus, the jammed paper cannot be removed. For this reason, the image transferring belt and the photoreceptor drum are stopped, and then moved backward.

Where the stopping conditions are satisfied, no paper is present between the image transferring belt and the second paper transporting unit including the fixing unit located downstream of the transferring belt. Similarly, no paper is present between the image transferring belt and the third paper transporting unit including the regi. roll located upstream of the transferring belt. Such a slight operation as to move the leading edge of the jammed paper back to the transferring belt position is enough for the reverse movement of the image transferring belt and the photoreceptor drum.

In the stopping condition of the fixing unit 100 in which it is brought into a stop with the pressure release, there is a case where the transferring belt stops with some delay after the photoreceptor drum stops. In this case, the POP jammed paper lies between the image transferring belt 7 and the cleaning member 15M of the photoreceptor drum 2M in a state that it is uncontrollable. An attempt to put the uncontrollably postured jammed paper in a controllable posture as much as possible can be achieved by reversely turning the transferring belt earlier than the photoreceptor drum by a time corresponding to the delay of the transferring belt behind the photoreceptor drum when those were stopped.

Upon detection of the POP jam, the photoreceptor drums are swiftly stopped. In a case where a signal representative of removal of the pressure from the fixing unit is generated simultaneously with the stop of the photoreceptor drums, and the transport removal by the fixing unit actually starts after 300 msec from the generation of the pressure removal signal, the transferring belt should not be stopped till the transport removal by the fixing unit. Accordingly, the transferring belt is stopped after 300 msec from the stop of the photoreceptor drum. The motion of the transferring belt during this period of time adversely affects the behavior of the POP jammed paper. However, the influence can be removed in the following manner. The transferring belt alone is reversely turned for 300 msec. With the reverse turn, the trailing edge of the paper is pulled, to thereby correct the abnormal posture of the jammed paper. Then, the transferring belt and the photoreceptor drum are reversely turned, to thereby move the leading edge of the jammed paper back to the transferring belt position.

For the means to return the leading edge of the POP jammed paper to the transferring belt position, the quantity of the reverse turn may be predicted on the basis of the reverse-turn time that is obtained considering the relationship between the paper sensor and the image transferring position, the time from its detection till the photoreceptor drum actually stops its turn, and the like. The reverse-turn stop time may also be calculated using the paper detecting information derived from the paper sensors disposed within the apparatus. After the reverse turn of the transferring belt ends, a message displayed on a message board of the apparatus directs the user to remove the papers from the apparatus. After seeing the message, the user can remove the papers from the apparatus safely and easily. After the paper removal work is completed, the apparatus restarts its normal operation without any damage.

Figure 8:
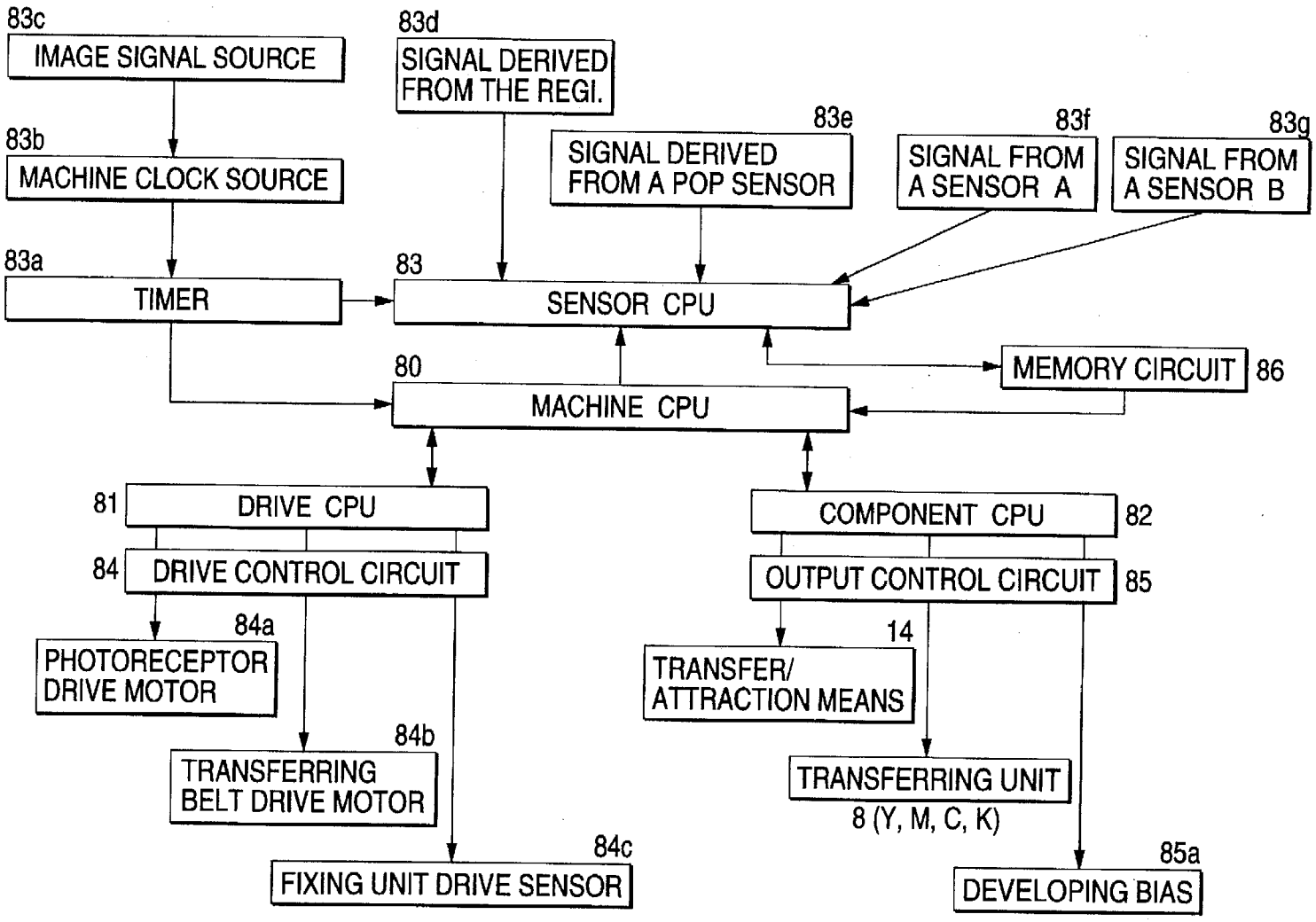
FIG. 8 is a block diagram showing a systematic combination of functional blocks for performing the operation of the embodiment of the image forming apparatus according to the present invention.

FIG. 8 is a block diagram showing a systematic combination of functional blocks for performing the operation of the embodiment of the image forming apparatus according to the present invention. In the figure, reference numeral 80 designates a central processing unit (machine CPU) for controlling the overall image forming apparatus; 81, a drive CPU for driving the paper transporting units and the like; 82, a component CPU for controlling the components in the image forming system; 83, a sensor CPU for detecting the paper sensors and the like; 83*a*, a timer; 83*b*, a machine clock source; 83*c*, an image signal source; 83*d*, a signal derived from the regi. sensor; 83*e*, a signal derived from a pop sensor; 83*f*, a signal from a sensor A (paper sensor in the unit); 83*g*, a signal from a sensor B (paper sensor between the units); 84, a drive control circuit for the paper transporting units and the like; 84*a*, a photoreceptor drive motor; 84*b*, a transferring belt drive motor; 84*c*, a fixing unit drive sensor 84*c*; 85, an output control circuit for supplying various image forming voltages; 85*a*, a developing bias; and 86, a memory circuit for storing paper detecting information derived from the paper sensors. Reference numeral 14 designates a transfer/attraction means and 8 (Y, M, C, K) designates an image transferring unit.

In the figure, the machine CPU 80 controls an overall operation of the image forming apparatus through the drive CPU 81, the component CPU 82, and the sensor CPU 83. A signal indicative of the presence or absence of the paper, which is derived from one of the paper sensors (regi. sensor, pop sensor, sensor A, sensor B), located in the units or between the adjacent units, is recognized by the sensor CPU 83, and the result is applied to the machine CPU 80.

At the same time, a status of each paper sensor as paper detecting information from each paper sensor, viz., low level/high level (H/L) information, is stored into the memory circuit 86. In accordance with the information of presence/absence of the paper from the paper sensors, the information from the memory circuit 86, and the paper-to-paper distance that is dependent on the print mode and set in the machine CPU 80, the drive CPU 81 controls the transferring belt drive motor 84*b*, and the fixing unit drive sensor 84*c*, through the drive control circuit 84, the drive control circuit 84, to thereby adjust the positions of the papers in the paper transporting units.

Figure 9:
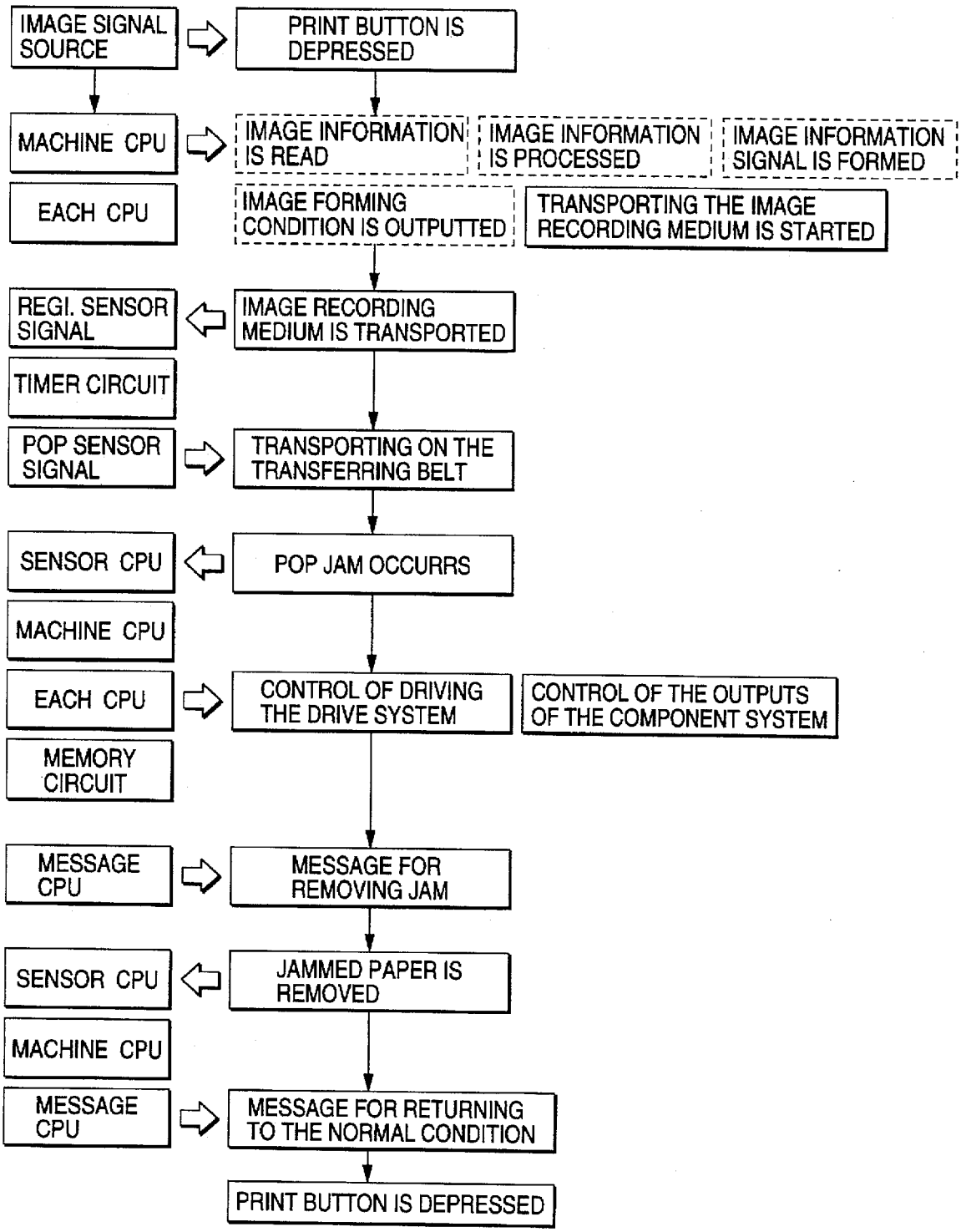
FIG. 9 is an explanatory diagram showing the CPUs used in the image forming apparatus according to the embodiment of the present invention, the functions of the CPUs, and the operation flows of the CPUs.

The paper transporting operation including the position adjustment of the jammed paper will further be described in detail. FIG. 9 is an explanatory diagram showing the CPUs used in the image forming apparatus according to the embodiment of the present invention, the functions of the CPUs, and the operation flows of the CPUs. In the figure, an original document as an image signal source is set to the image forming apparatus, and a print button is depressed. The apparatus reads an image from the document, processes the readout image in a predetermined manner, to thereby form image forming signals. The apparatus outputs image forming conditions to given image forming members, and starts the transport of the image recording medium (paper).

The transport of the papers starts, and the papers are successively attracted onto the transferring belt and transported. During the course of the image transferring operation, when the in-unit paper sensor (pop sensor), which is disposed immediately downstream of the photoreceptor drum of the first paper transporting unit 30, detects the paper absence, the respective CPUs control the driving of the drive systems, whereby the POP jammed paper and the other papers present in the apparatus, as described above, are positioned to such locations as to readily be accessed for paper removal. At the same time, the CPUs control the outputs of the component system to stop the supply of the voltages to the attraction means, the fixing unit, the developing units and the like.

A message to remove the jammed paper is displayed on the message board. Specifically, the paper transporting unit at which a jam trouble is located and the direction to remove the jammed paper are visually presented to the user. The user sees the message, removes the POP jammed paper, and put the paper transporting unit back to the original position, so that the apparatus is restored to a normal state. The result is displayed on the message board. After confirming the displayed result, the user depresses the print button and the apparatus starts the print work again.

Figure 10:
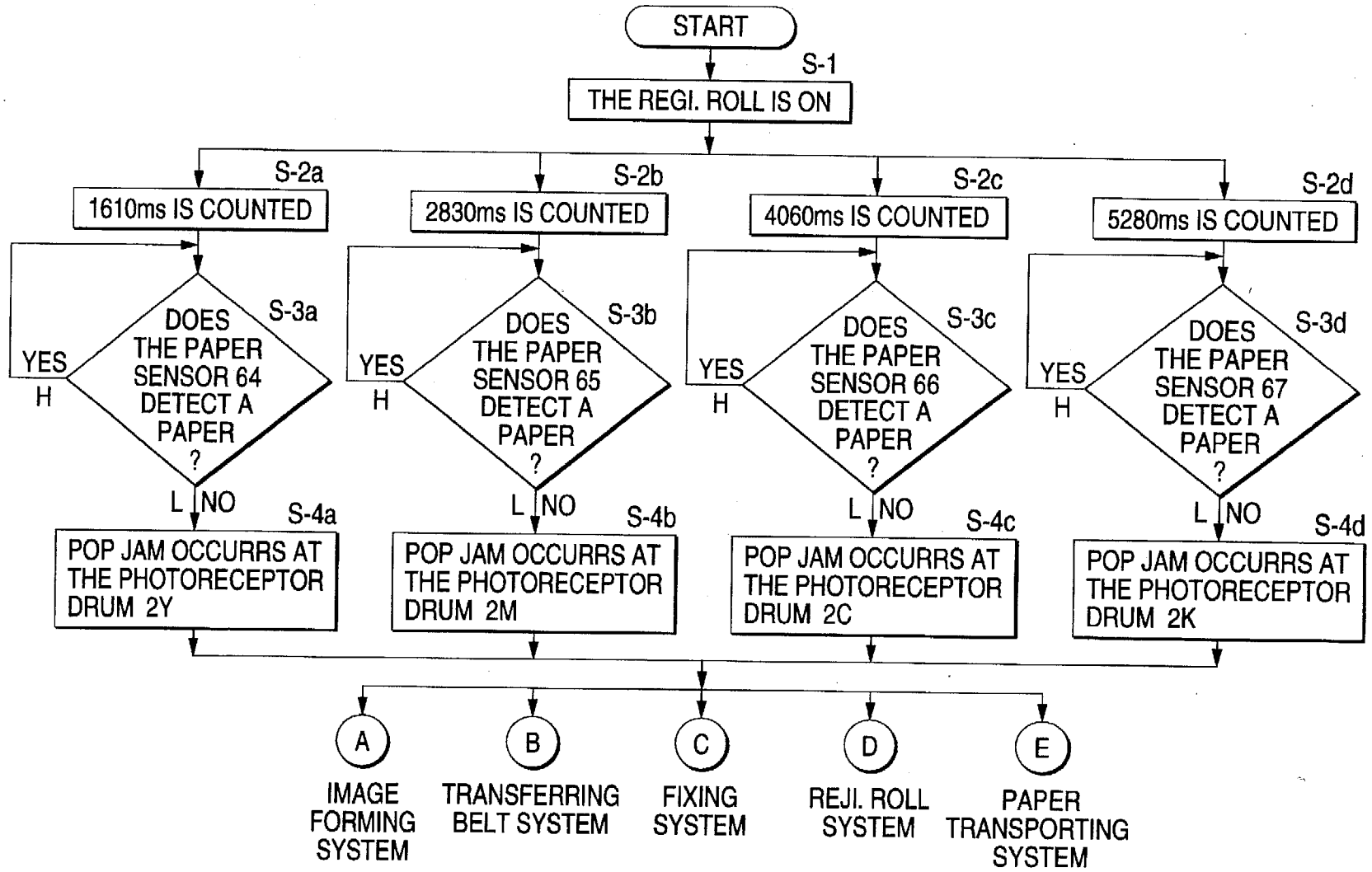
FIG. 10 is a partial flowchart for explaining an operation of the image forming apparatus when a POP jam happens.

FIGS. 10 to 14 are partial flowcharts for explaining an example of the operation of the present embodiment when a POP jam happens. Count times by the timer are given by way of example. In FIG. 10, the machine (image forming apparatus) starts its operation, the supply of papers from the paper tray starts, the regi. roll is on (the regi. sensor 63 in FIG. 4 detects the presence of a paper) (S-1), and the timer circuit (timer 83*a* in FIG. 8) starts to count time.

In a case where the paper sensor 64, which is disposed close to the photoreceptor drum 2Y in the first paper transporting unit 30, detects no paper (S-3*a*) at a time point where the timer circuit counts 1610 ms after counting time from the turn-on of the regi. roll (S-2*a*), it is judged that a POP jam has occurred at the photoreceptor drum 2Y (S-4*a*). In a case where the paper sensor 65, which is disposed close to the photoreceptor drum 2M in the first paper transporting unit 30, detects no paper (S-3*b*) at a time point where the timer circuit counts 2830 ms after counting time from the turn-on of the regi. roll (S-2*b*), it is judged that a POP jam has occurred at the photoreceptor drum 2M (S-4*b*).

In a case where the paper sensor 66, which is disposed close to the photoreceptor drum 2C in the first paper transporting unit 30, detects no paper (S-3*c*) at a time point where the timer circuit counts 4060 ms after counting time from the turn-on of the regi. roll (S-2*c*), it is judged that a POP jam has occurred at the photoreceptor drum 2C (S-4*c*).

In a case where the paper sensor 67, which is disposed close to the photoreceptor drum 2K in the first paper transporting unit 30, detects no paper (S-3*d*) at a time point where the timer circuit counts 5280 ms after counting time from the turn-on of the regi. roll (S-2*d*), it is judged that a POP jam has occurred at the photoreceptor drum 2K (S-4*d*).

Figure 11:
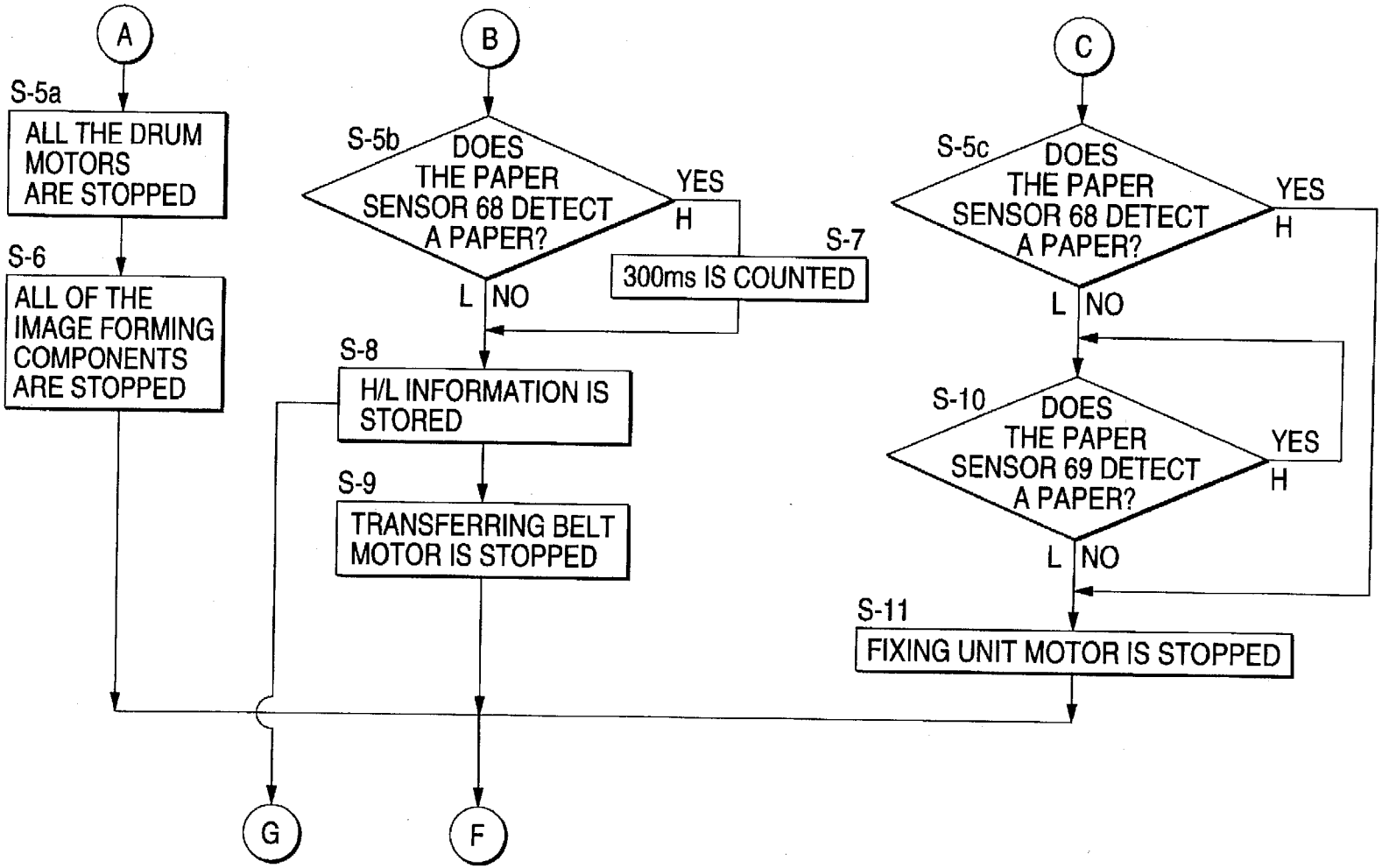
FIG. 11 is another partial flowchart for explaining the same.

In FIG. 11, if a POP jam happens at any of the photoreceptor drums, all of the drum motors are stopped (S-5*a*) and all of the image forming components are stopped (S-6) in the image forming system. In the image transferring belt system, if the paper sensor 68 senses a paper, the timer circuit counts 300 ms, the status (H/L) information of the paper sensor 68 is stored into the memory circuit 86 (FIG. 8), and the transferring belt motor is stopped (S-9). If the sensor senses no paper, the status information is stored into the memory circuit, and the transferring belt motor is stopped.

Figure 12:
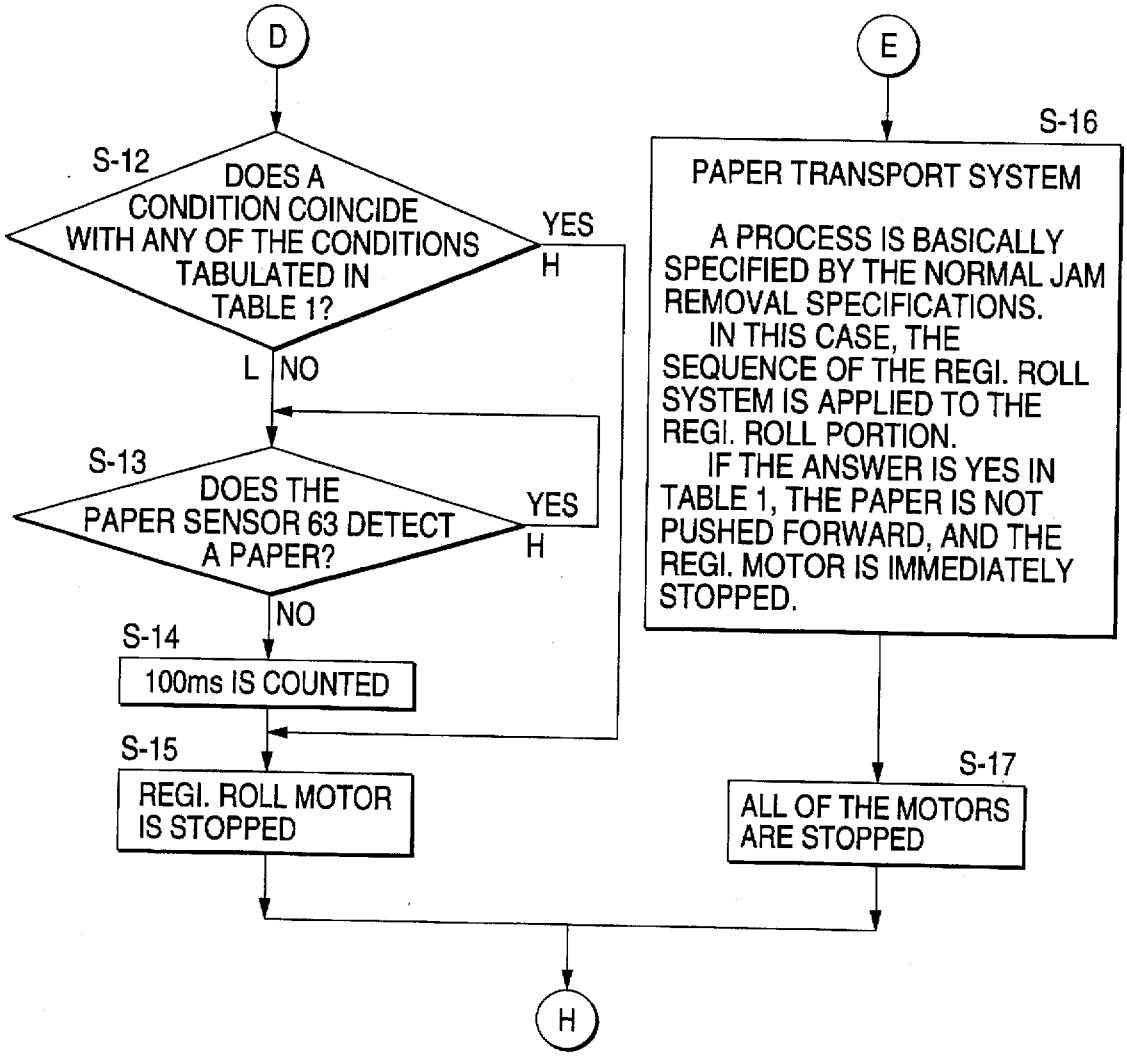
FIG. 12 is a yet another partial flowchart for explaining the same.

In the fixing system, if the paper sensor 68 detects a paper, the fixing unit motor is stopped (S-11). If it detects no paper, the paper sensor 69 produces a no-paper signal (S-10) and the fixing unit motor is stopped (S-11). Referring now to FIG. 12, if a POP jam occurs at any of the photoreceptor drums in FIG. 10, it is judged whether or not a condition coincides with any of the conditions tabulated in "Table 1" (S-12), in the regi. roll system. If the answer is YES, the regi. roll is stopped (S-15). If the answer is NO, it is judged whether or not the paper sensor 63 detects a paper. If the answer is YES, 100 ms is counted (S-14), and the regi. roll motor is stopped (S-15).

In the paper transporting system (paper feeding system), a process is carried out, which is basically specified by the normal jam removal specifications (S-16). In this case, the sequence of the regi. roll system is applied to the regi. roll portion. In the sequence of the regi. roll system, if the answer to the step S-12, which is for judging whether or not a condition coincides with any of the conditions in Table 1, is YES, the regi. motor is driven and the paper is not pushed forward, and the regi. motor is immediately stopped to stop all of the motors (S-17).

Figure 13:
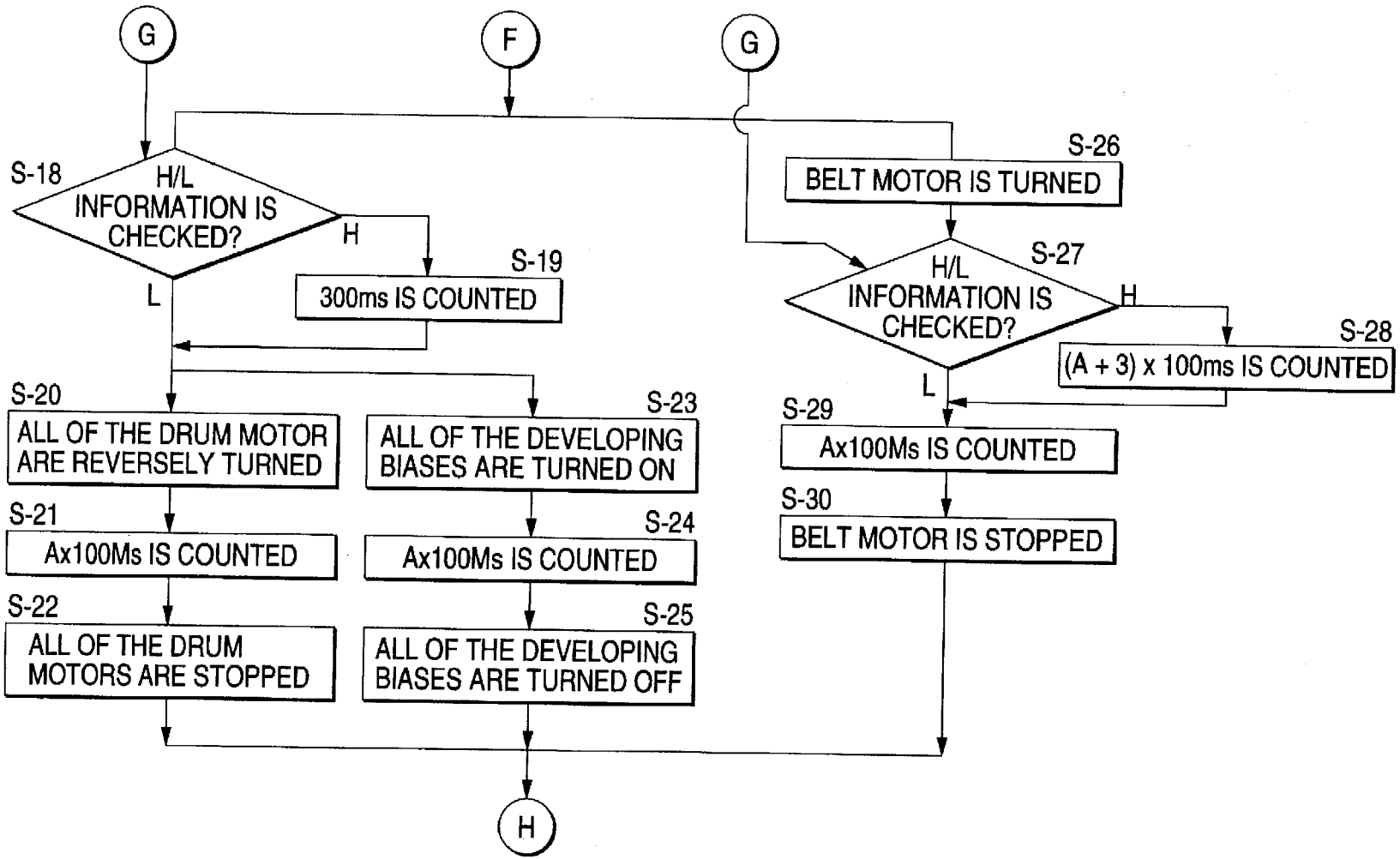
FIG. 13 is a still another partial flowchart for explaining the same.

Reference is made to FIG. 13. Following the steps S-6, S-9 and S-11 in FIG. 11, the status (H/L) information stored in the memory circuit 86 is checked. If the status information is L, all of the drum motors are reversely turned (S-20), A×100 ms is counted (S-21), and all of the drum motors are stopped (S-22). Further, all of the developing biases are turned on (S-23), A×100 ms is counted (S-24), and all of the developing biases are turned off (S-25).

If the status information is H, 300 ms is counted (S-19), and a step S-20 is executed. Simultaneously with the execution of the step S-18, the belt motor is turned (S-26). The status (H/L) information stored in the memory circuit 86 is checked. If the status information is H, (A+3)×100 ms is counted (S-28) and the belt motor is stopped (S-30). If it is L, (A×100 ms) is counted (S-29), and the belt motor is stopped (S-30).

Figure 14:
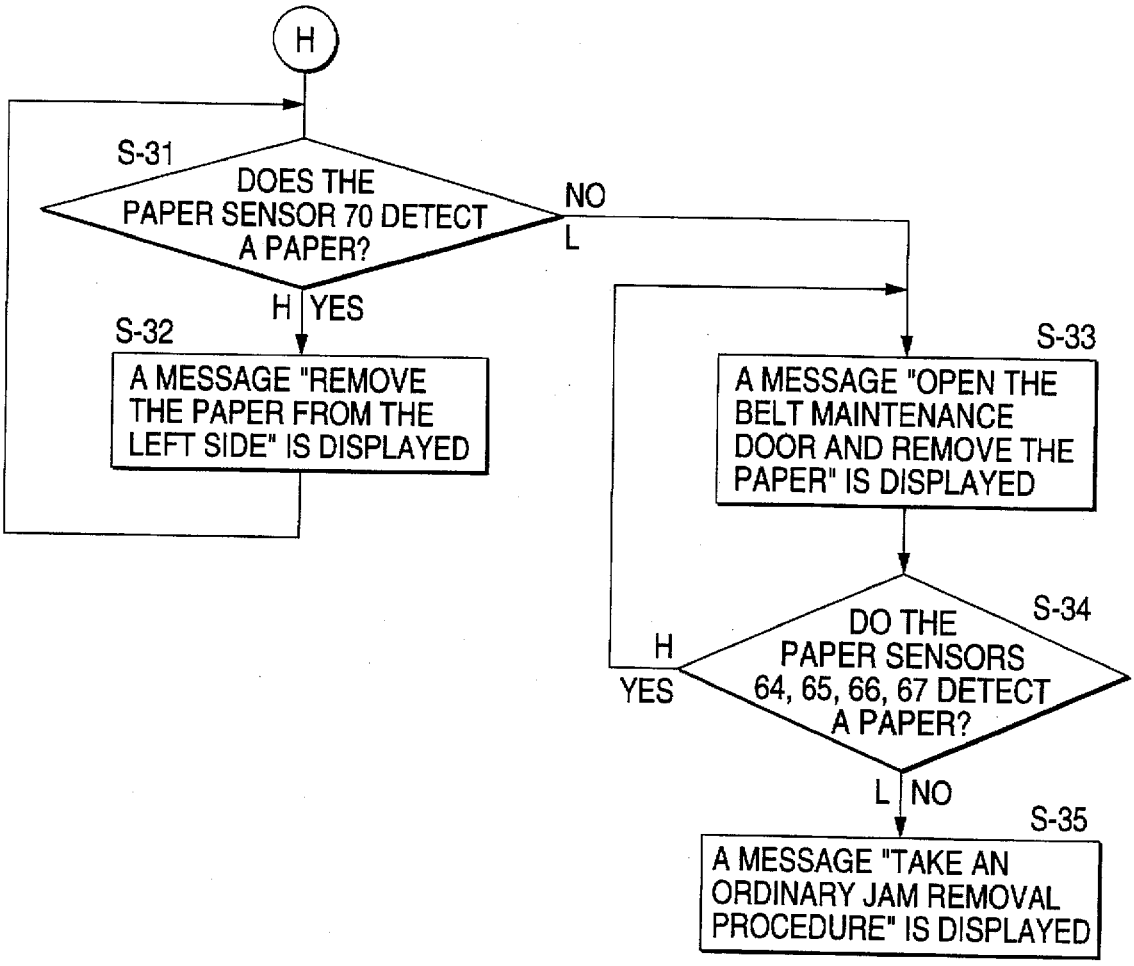
FIG. 14 is a further partial flowchart for explaining the same.

The value of "A" is determined as occasion arises. The belt motor has a time lag between the reception of a start signal and an actual start thereof. The time lags of the belt motors are not uniform in this case, "A" is set at a value so as to adjust the time lag. When a jam happens, it is necessary to position the papers to such locations as to readily be accessed for paper removal. In this case, "A" is set at such a value as to obtain an optimum time for reversely turning the motor. Reference is made to FIG. 14. Following the steps of stopping all of the drum motors (S-22), turning off all of the developing biases (S-25), and stopping the belt motor (S-30), it is checked whether or not the paper sensor 70 (FIG. 4) is detects a paper (S-31). If it detects the paper (H), viz., the paper is present between the second and the third paper transporting units 31 and 32, a message "Remove the paper from the left side." of the machine is displayed on the message board (S-32).

If the step S-31 determines that no paper is detected, a message "Open the belt maintenance door and remove the paper." is displayed on the message board (S-33). It is checked whether or not any of the paper sensors 64, 65 and 66 detects a paper (S-34). If the answer is YES, all of the papers in the first paper transporting unit 30 are removed. If the answer is NO, a message "Take an ordinary jam removal procedure" is displayed on the message board (S-35). A modification of the image forming apparatus thus far described in which when the image transferring belt is stopped, the belt is detached from the photoreceptor drums in the image forming apparatus, will be described.

Figure 15:
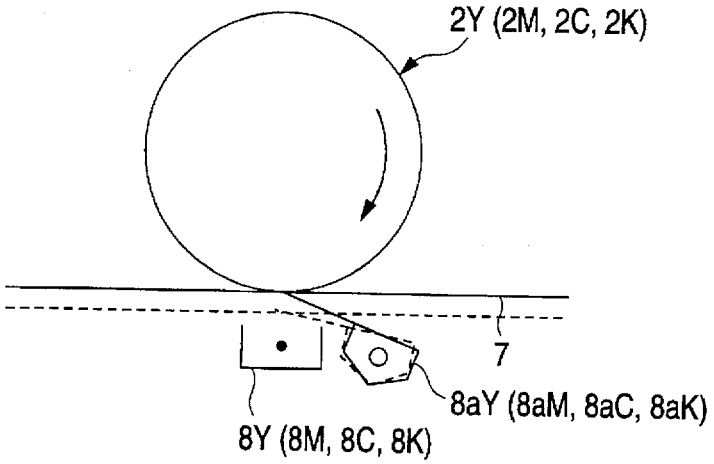
FIG. 15 is an enlarged view showing a key portion of a modification of the image forming apparatus where a positional relation between an image transferring baffle and the transferring belt is illustrated.

The image transferring belt 7 shown in FIG. 1, for example, consists of an endless dielectric film of 75 μm thick both ends of which are bonded together by an ultrasonic welding method. The transferring belt is wound around four rolls including the drive roll 9, which is connected to the drive motor, in a stretching fashion. As shown in FIG. 15, a plate-like transferring baffle 8aY (8aM, 8aC, 8aK) is disposed on the rear side of the image transferring belt 7, which is disposed facing the photoreceptor drum 2Y (2M, 2C, and 2K), in a state that it covers a part of the image transferring charger 8Y ((8M, 8C, 8K). The baffle 8aY (8aM, 8aC, 8aK) pushes the rear side of the image transferring belt 7, and swings when a solenoid (not shown) is turned on and off. With the swing motion of the baffle 8aY (8aM, 8aC, 8aK), the image transferring belt 7 is brought into contact with the photoreceptor drum 2Y (2M, 2C, and 2K) (indicated by a solid line), and detached from the drum (indicated by a broken line).

Figure 16:
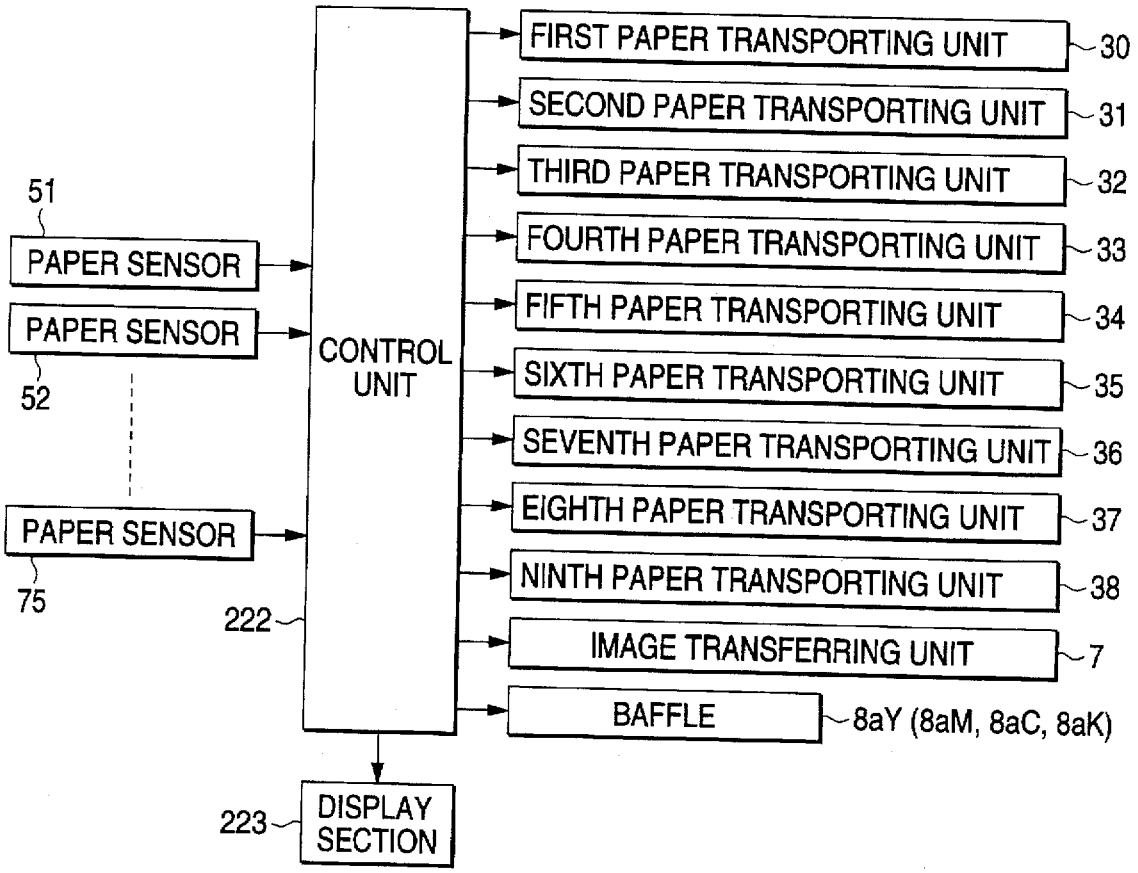
FIG. 16 is a block diagram showing a control system for a jam removal process according to the present invention.

As shown in FIG. 16, the output signals of the paper sensors 51 to 75 are inputted to a control unit 222, which consists of a microcomputer system storing given programs. The control unit 222 specifies a location of jam trouble on the basis of the signals from the sensors. The control unit 222 selects the unit or belt to be stopped from among those units 30 to 38 and the image transferring belt 7 on the basis of the jam location, and sends a drive stop signal to the selected one. If the image transferring belt 7 is to be stopped, the control unit sends an off signal to the solenoid that swings the baffle 8aY (8aM, 8aC, 8aK), so that the image transferring belt 7 is detached from the photoreceptor drums 2Y, 2M, 2C and 2K in the image forming units. The control unit 222, which has sent the drive stop signal, requests a display section 223 of the copying machine, which is a user interface, to display a jam location and jam removal information thereon.

During a copying work in a normal color copy mode in a state that the paper tray 112-3 is designated, when the control unit 222 locates a jam in the second paper transporting unit 31, it is already impossible to discharge the paper lying on the transporting path through the paper-discharge transporting roll pair 119. Accordingly, the control unit sends a drive stop signal to all of the seventh paper transporting unit 36, the sixth paper transporting unit 35, the image transferring belt 7, and the second paper transporting unit 31, and an off signal to the solenoid for the baffle 8aY (8aM, 8aC, 8aK).

When the control unit 222 locates a jam in the sixth paper transporting unit 35 during the same copying work, no problem arises in discharging the paper already attracted to the image transferring belt 7 through the paper-discharge transporting roll pair 119. Therefore, the control unit sends a drive stop signal to only the seventh paper transporting unit 36 and the sixth paper transporting unit 35. The toner image is transferred and fixed onto the papers currently lying on the image transferring belt 7, as in the copying work. When those papers have been discharged through the paper-discharge transporting roll pair 119, the control unit sends a drive stop signal to the image transferring belt 7 and the second paper transporting unit 31, and an off signal to the solenoid for the baffle 8aY (8aM, 8aC, 8aK).

During a copying work in a both-side color copy mode in a state that the paper tray 112-3 is designated, when the control unit 222 locates a jam in the seventh paper transporting unit 36, The papers lying in the sixth paper transporting unit 35 and the fourth paper transporting unit 33 or the papers held on the image transferring belt 7 can be discharged through the paper-discharge transporting roll pair 119. Accordingly, the control unit 222 sends a drive stop signal to only the seventh paper transporting unit 36, and continues the driving of the sheet supply unit, the image transferring belt 7, the second paper transporting unit 31, and the fourth paper transporting unit 33 as it drove them before the jam happens. As a result, the papers that were fed out of the seventh paper transporting unit 36 and now are transported in the apparatus are discharged in a state that the papers have images formed on both sides thereof. Upon completion of the paper discharging operation, the control unit 222 sends a drive stop signal to the sixth paper transporting unit 35, the fourth paper transporting unit 33, the image transferring belt 7, and the second paper transporting unit 31, and an off signal to the solenoid for the baffle 8aY (8aM, 8aC, 8aK).

As described above, in the modified color image forming apparatus, when a jam trouble is detected and the driving of the image transferring belt 7 is stopped in response to the jam detecting signal, the baffle 8aY (8aM, 8aC, 8aK) is necessarily turned to detach the image transferring belt 7 from the photoreceptor drum 2Y (2M, 2C, and 2K). Accordingly, even if the user leaves the jammed paper unremoved for a long time, and hence the jammed state of the apparatus is left as it is, an abnormal potential history is not depicted in the photoreceptor drum 2Y (2M, 2C, and 2K) of the image forming unit 9. Further, the parting oil of the fixing unit, which has moved and adhered to the image recording medium bearing member 8, shaped like a belt, through the paper 3 having the images formed on both sides thereof, can effectively be prevented from being transferred to the follower roll 10.

When the jammed paper is removed from such an apparatus and the apparatus is operated again, the resultant image does not have a stripe pattern extending orthogonal to the paper transporting direction, and hence will have a high image quality.

In the present modified color image forming apparatus, the transferring baffles disposed in opposition to the photoreceptor drums with respect to the image transferring belt 7 is turned to detach the image transferring belt 7 from the photoreceptor drums. In an alternative, the apparatus frame per se, which rotatably supports the image transferring belt 7, is made to descend for the same purpose.

Thus, in the embodiment of the present invention, the jammed paper can easily be removed from the apparatus. While in the above-mentioned embodiment, the present invention is applied to the color image forming apparatus, the called tandem type digital color copying machine, it is evident that the invention may be applied to another type of the image forming apparatus.

As seen from the foregoing description, in the image forming apparatus of the invention, the operations of the paper transporting units are determined on the basis of paper position information of paper positions in the paper transporting unit or between the units. Therefore, the jammed paper and the papers running before and after the jammed paper may be removed without damaging the apparatus or tearing the papers. Further, even if the jammed state of the apparatus is left as it is for a long time, no adverse effect is produced on the apparatus. Accordingly, when the jammed paper is removed from such an apparatus and the apparatus is operated again, the resultant image will have a high quality.

What is claimed is:

1. An image forming apparatus comprising:

a plural number of paper transporting units including at least first and second paper transporting units;

in-unit paper sensing means located in said first paper transporting unit;

unit-to-unit paper sensing means located between said first and second paper transporting units; and drive control means for controlling the operations of the plural number of said paper transporting units, wherein said drive control means includes:

first means operating such that when any of said in-unit paper sensing means located in said first paper transporting unit detects a paper transport trouble, said first means stops the paper transporting operation of said second paper transporting unit in response to a sensing signal indicative of the presence of a paper from said unit-to-unit paper sensing means, and second means stops the paper transporting operation of said first paper transporting unit upon the stop of the paper transporting operation of said second paper transporting unit, and drives said first paper transporting unit to move the paper a predetermined distance in the direction that is reverse to the normal direction.

2. The image forming apparatus of claim 1, wherein said first paper transporting unit includes one or a plural number of photoreceptor drums and an image transferring belt, and said second paper transporting unit is a fixing unit for processing the paper having an image already transferred thereonto, which is delivered from said first paper transporting unit, for fixing the image thereonto.

3. The image forming apparatus of claim 2, wherein said in-unit paper sensing means in said first paper transporting unit is disposed downstream of said image transferring means on the paper transporting path.

4. The image forming apparatus of claim 2, wherein said in-unit paper sensing means in said first paper transporting unit is disposed upstream of a cleaning member located on said photoreceptor drum.

5. An image forming apparatus comprising:

a plural number of paper transporting units including;

a first paper transporting unit forming an image transferring means, a second paper transporting unit forming a fixing unit for processing the paper having an image already transferred thereonto, which is delivered from said first paper transporting unit, for fixing the image thereonto, and a third paper transporting unit forming a paper feeding means for feeding papers to said first paper transporting unit;

in-unit paper sensing means located in said first paper transporting unit;

unit-to-unit paper sensing means located between said first and second paper transporting units; and drive control means for controlling the operations of the plural number of said paper transporting units, wherein said drive control means includes first means operating such that when any of said in-unit paper sensing means located in said first paper transporting unit detects a paper transport trouble, said first means stops the paper transporting operation of said second paper transporting unit in response to a sensing signal indicative of the presence of a paper from said unit-to-unit paper sensing means located between said first and second paper transporting units, second means stops the paper transporting operation of said first paper transporting unit upon the stop of the paper transporting operation of said second paper transporting unit, and drive said first paper transporting unit to move the paper a predetermined distance in the direction that is reverse to the normal direction, and third means operating such that when said unit-to-unit paper sensing means located between said first paper transporting unit and said third paper transporting unit detects a paper transport trouble, said third means pushes the paper into said first paper transporting unit.

6. The image forming apparatus of claim 5, wherein said in-unit paper sensing means in said first paper transporting unit is disposed downstream of said image transferring means on the paper transporting path.

7. The image forming apparatus of claim 5, wherein said in-unit paper sensing means in said first paper transporting unit is disposed upstream of a cleaning member located on said photoreceptor drum.

8. An image forming apparatus, comprising:

a photoreceptor on which a toner image defined by image information is formed;

an endless image transferring belt for transporting a paper to a toner image transferring stage with turn of said transferring belt, said image transferring belt being disposed in a state that said image transferring belt may be brought into contact with said photoreceptor and separated from said photoreceptor;

paper sensing means, disposed along a paper transporting path including said image transferring belt, for detecting a jam trouble on the paper transporting path;

means for stopping the turn of said image transferring belt when said paper sensing means detects a jam;

means for detaching said image transferring belt from said photoreceptor when the turn of said image transferring belt is stopped; and means for directing a user to remove a jammed paper from said image forming apparatus wherein when the papers, which lie on the paper transporting path, include such papers as to be discharged out of said image forming apparatus without moving the jammed paper, the turn of said image transferring belt is stopped after such papers are discharged out of said image forming apparatus.

9. The image forming apparatus of claim 8, wherein pressing means for pressing said image transferring belt against said photoreceptor is disposed in opposition to said photoreceptor with respect to said image transferring belt, and when the pressing force of said pressing means is removed, said image transferring belt is detached from said photoreceptor.

* * * * *